US009541341B2

(12) United States Patent
Macy

(10) Patent No.: US 9,541,341 B2
(45) Date of Patent: Jan. 10, 2017

(54) METHOD AND APPARATUS FOR SELF-RESETTING TRIGGER MECHANISM

(71) Applicant: Omar Alonso Macy, Gilroy, CA (US)

(72) Inventor: Omar Alonso Macy, Gilroy, CA (US)

(73) Assignee: Real Action Paintball (RAP4), Inc., Gilroy, CA (US)

( * ) Notice: Subject to any disclaimer, the term of this patent is extended or adjusted under 35 U.S.C. 154(b) by 0 days.

(21) Appl. No.: 14/578,249

(22) Filed: Dec. 19, 2014

(65) Prior Publication Data

US 2016/0178303 A1 Jun. 23, 2016

(51) Int. Cl.

| | |
|---|---|
| ***F41A 19/00*** | (2006.01) |
| ***F41B 11/00*** | (2013.01) |
| ***F41A 19/10*** | (2006.01) |
| ***F41A 19/12*** | (2006.01) |
| ***F41A 19/16*** | (2006.01) |

(52) U.S. Cl.

CPC ..... *F41A 19/10* (2013.01); *F41A 19/12* (2013.01); *F41A 19/16* (2013.01); *F41B 11/00* (2013.01)

(58) Field of Classification Search

CPC ..... F41A 19/10; F41A 19/16; F41B 11/00
USPC ..... 42/69.01; 124/31, 71, 72; 89/132, 136
See application file for complete search history.

(56) References Cited

U.S. PATENT DOCUMENTS 5,157,209 A * 10/1992 Dunn ..... F41A 17/64 42/70.08
5,485,776 A * 1/1996 Ealovega ..... F41A 19/33 89/130
6,802,305 B1 * 10/2004 Hatcher ..... F41A 19/10 124/31
6,820,606 B1 * 11/2004 Duffey ..... F41B 11/00 124/31
6,880,281 B1 * 4/2005 Orr ..... F41A 17/46 42/69.01
7,069,922 B1 * 7/2006 Orr ..... F41A 23/10 124/73
7,111,621 B2 * 9/2006 Lin ..... F41B 11/62 124/74
7,121,273 B2 * 10/2006 Styles ..... F41A 7/08 124/77
7,581,954 B2 * 9/2009 Schavone ..... F41B 11/51 124/74
7,784,454 B2 * 8/2010 Tiberius ..... F41B 11/51 124/72
7,900,622 B2 * 3/2011 Douglas ..... F41B 11/57 124/32

(Continued)

*Primary Examiner* — Alexander Niconovich
(74) *Attorney, Agent, or Firm* — James M. Wu; JW Law Group

(57) ABSTRACT

A projectile launcher using a self-resetting trigger system includes a striker, a sear, and a trigger. The striker, also known as hammer, includes an anchoring notch and is able to slide between a firing position and a ready-for-firing position for launching an object. The sear, which is substantially L-shaped sear, has a first sear end and a second sear end wherein the sear maintains the striker to the ready-for-firing position when the first sear end engages with the anchoring notch of the striker. The trigger, which is capable of self resetting independent from the movement of the striker, contains an elastic lip with a ramp and is able to maintain the sear in a ready position when the elastic lip and the second sear end are coupled in a lock position.

16 Claims, 22 Drawing Sheets

(56) References Cited

U.S. PATENT DOCUMENTS

| | | | | |
|---|---|---|---|---|
| 8,235,031 | B2 * | 8/2012 | Kim | F41B 11/57 124/77 |
| 8,510,980 | B2 * | 8/2013 | Lee | F41A 19/10 42/69.01 |
| 8,646,201 | B2 * | 2/2014 | Hughes | F41A 19/15 42/1.01 |
| 8,656,619 | B2 * | 2/2014 | Popikov | F41A 19/16 42/69.01 |
| 8,683,990 | B2 * | 4/2014 | Macy | F41B 11/70 124/73 |
| 8,863,425 | B2 * | 10/2014 | Lee | F41A 19/10 42/69.01 |
| 9,021,732 | B2 * | 5/2015 | Johnson | F41A 19/09 42/69.01 |
| 2003/0056778 | A1 * | 3/2003 | Schavone | F41B 11/51 124/74 |
| 2006/0086031 | A1 * | 4/2006 | Geissele | F41A 19/16 42/69.03 |
| 2006/0265929 | A1 * | 11/2006 | Haney | F41G 3/2655 42/116 |
| 2011/0139139 | A1 * | 6/2011 | Knuth | F41B 11/57 124/77 |
| 2011/0226227 | A1 * | 9/2011 | Douglas | F41B 11/57 124/77 |
| 2011/0252681 | A1 * | 10/2011 | Houde-Walter | F41G 1/35 42/1.01 |
| 2015/0308784 | A1 * | 10/2015 | Cho | F41A 19/10 124/31 |

* cited by examiner

METHOD AND APPARATUS FOR SELF-RESETTING TRIGGER MECHANISM

FIELD

The present invention relates to projectile launch system or apparatus. More specifically, the present invention relates to triggering system used for a projectile launcher capable of launching an object.

BACKGROUND

Various configurations of paintball guns and/or markers which could be used for practical applications, recreational, and shooting trainings have become popular in recent years. For example, paintball guns can be used in professional trainings for soldiers, police officers, security personals, and/or athletic participants. The success of training and/or competition may largely depend on how closely the paintball guns mimic and/or resemble the real firearms or semi-automatic hand guns.

A drawback associated with a conventional paintball gun or marker in place of a real gun is that the appearance and handling of a conventional paintball marker are different from the appearance and handling of real firearms. Since internal structure of a paintball marker is organized differently from the internal structure of firearms, operating and handling of a paintball marker are typically different from real firearms. For example, trigger pulling weight such as takeup and creep can be different between a paintball marker and a rifle.

SUMMARY

A projectile launcher such as a paintball gun or firearm capable of launching or firing an object using a self-resetting trigger system is disclosed. The launcher, in one embodiment, includes a striker, a sear, and a trigger. The striker, also known as hammer, includes an anchoring notch and is able to slide between a firing position and a ready-for-firing position for launching an object. The object, in one example, is a paintball. Alternatively, the objection can be a bullet. The sear, which can be shaped in L or substantially L-shaped sear, has a first sear end and a second sear end. A function of the sear is to hold the striker to the ready-for-firing position when the first sear end engages with the anchoring notch of the striker. The trigger, in one embodiment, is capable of self resetting independent from the movements of the striker. The trigger includes an elastic lip with a ramp and is able to maintain the sear in a ready position when the elastic lip and the second sear end are coupled in a lock position.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
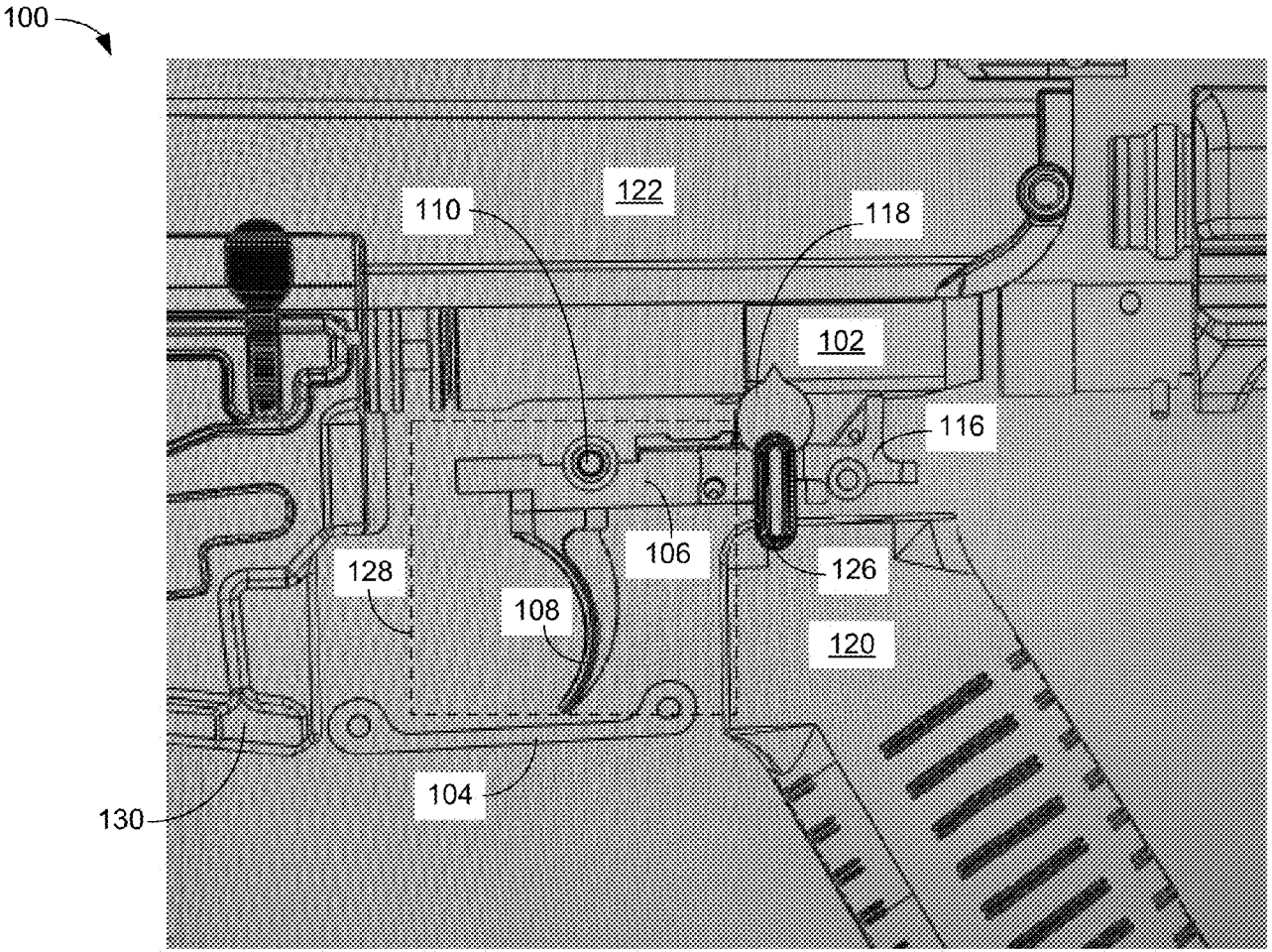
FIG. 1 is a diagram showing an exemplary projectile launcher having a self-resetting trigger mechanism in accordance with one embodiment of the present invention.

Exemplary embodiment(s) of the present invention is described herein in the context of a method, system and apparatus of providing a launcher able to launch an object using a self-resetting trigger mechanism.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

One embodiment of the presently disclosed invention illustrates a projectile launcher using a self-resetting trigger mechanism. The projectile launcher such as a paintball gun or firearm is capable of firing an object using a self-resetting trigger system. A paintball launcher, for example, includes a striker, a sear, and a trigger. The striker, also known as hammer, includes an anchoring notch and is able to slide between a firing position and a ready-for-firing position for launching an object. The sear, which can be an L-shaped or substantially L-shaped sear, has a first sear end and a second sear end. A function of sear is that it holds the striker to the ready-for-firing position when the first sear end engages with the anchoring notch of the striker. The trigger, which is capable of self resetting independent from movements of the striker, contains an elastic lip with a ramp and is able to maintain the sear in a ready position when the elastic lip and the second sear end are coupled in a lock position. An advantage of employing a self-resetting trigger mechanism is that it is able to provide training, launching paintballs, and/or firing ammunition.

FIG. 1 is a diagram 100 showing an exemplary projectile launcher having a self-resetting trigger mechanism in accordance with one embodiment of the present invention. Diagram 100 illustrates mechanical components of a paintball launcher that includes a bolt 122, striker 102, switch 118, sear 116, trigger 128, grip 120, and magazine receiver port 130. Magazine receiver port 130 is configured to receive projectiles such as paintballs from a magazine, not shown in diagram 100, for facilitating launch. It should be noted the underlying concept of the exemplary embodiment(s) of the present invention would not change if one or more components (or units) were added to or removed from diagram 100.

Bolt 122, in one aspect, is situated inside of a bolt chamber. A function of bolt 122 is to push a paintball into a firing chamber and then channels a stream of compressed or pressurized gas or air to launch the paintball. An object can also be referred to as any projectile, such as, but not limited to, a paintball, a non-lethal projectile, a less-lethal projectile, and/or a lethal projectile. Non-lethal projectile can be a food-color based paintball, and lethal projectile can be a bullet.

A paintball or a delivery shell, for instance, carries colored paint or marker and it breaks upon a high speed impact. The ammunition generally refers to gunpowder based bullets and/or cartridges which are projectiles propelled by firearms. It should be noted that the terms "paintball," "non-lethal projectile," "less-lethal projectile," and "lethal projectile" may be used interchangeably herein.

Striker 102, which can also be replaced with a hammer, is a spring loaded hitter that travels along an axis and is able to hit a firing pin. For a paintball launcher, the firing pin, for example, can be a valve pin which controls the valve of a paintball gun. When trigger 128 is pulled or squeezed which causes sear 116 to release striker 102, striker 102 engages a firing pin or valve pin to launch a projectile. When striker 102 is replaced with a hammer, the hammer, which is a spring-tensioned metal block, pivots around a pin to create a strike which discharges an object.

Trigger 128, in one embodiment, includes a lever 108, disconnector 106, and trigger pin 110. Note that lever 108, disconnector 106, and trigger pin 110 can be fabricated in separate pieces or one single component. Lever 108 is able to pivot around trigger pin 110 when a pressure is applied to lever 108. For example, when lever 108 is pulled or squeezed, it pushes sear 116 to release striker 102. Trigger guard 104 and grip 120 are used to guide the interface between lever 108 and index finger of a user. In one aspect, trigger 128 is configured to be able to self reset independent from the movement or cycle of striker 102.

Switch 118 contains a switch handle 126 allowing a user to select operation modes. For example, switch 118 is able to provide a single mode, automatic mode, and/or training mode. A single mode refers to a single fire each time a lever or trigger is pulled. An automatic mode indicates continuous firing as long as lever 108 is continuously pulled or squeezed. A training mode is triggering exercise that allows a user to pull lever 108 or trigger without cycling or moving the striker or hammer.

In operation, when striker 102 is cocked, striker 102 is maintained in the ready-for-firing position by sear 116. When lever 108 is pulled, disconnector 106 changes the orientation of sear 116 which subsequently releases striker 102. After striking a valve pin, a stream of pressurized gas is released by the valve. Once the pressurized gas reaches an object such as a paintball, the object is launched. After striker 102 cycles back, sear 116 catches striker 102 and holds striker 102 to the ready-for-firing position. Trigger 128 subsequently resets itself to a ready to retrigger position.

An advantage of using a self-resetting trigger mechanism is that it provides triggering exercise or triggering training without cycling a striker or hammer. In an alternative embodiment, the self-resetting trigger includes an electronic sensor and recording component which are able to sense and record user's triggering accuracy based on the triggering training performance.

Figure 2:
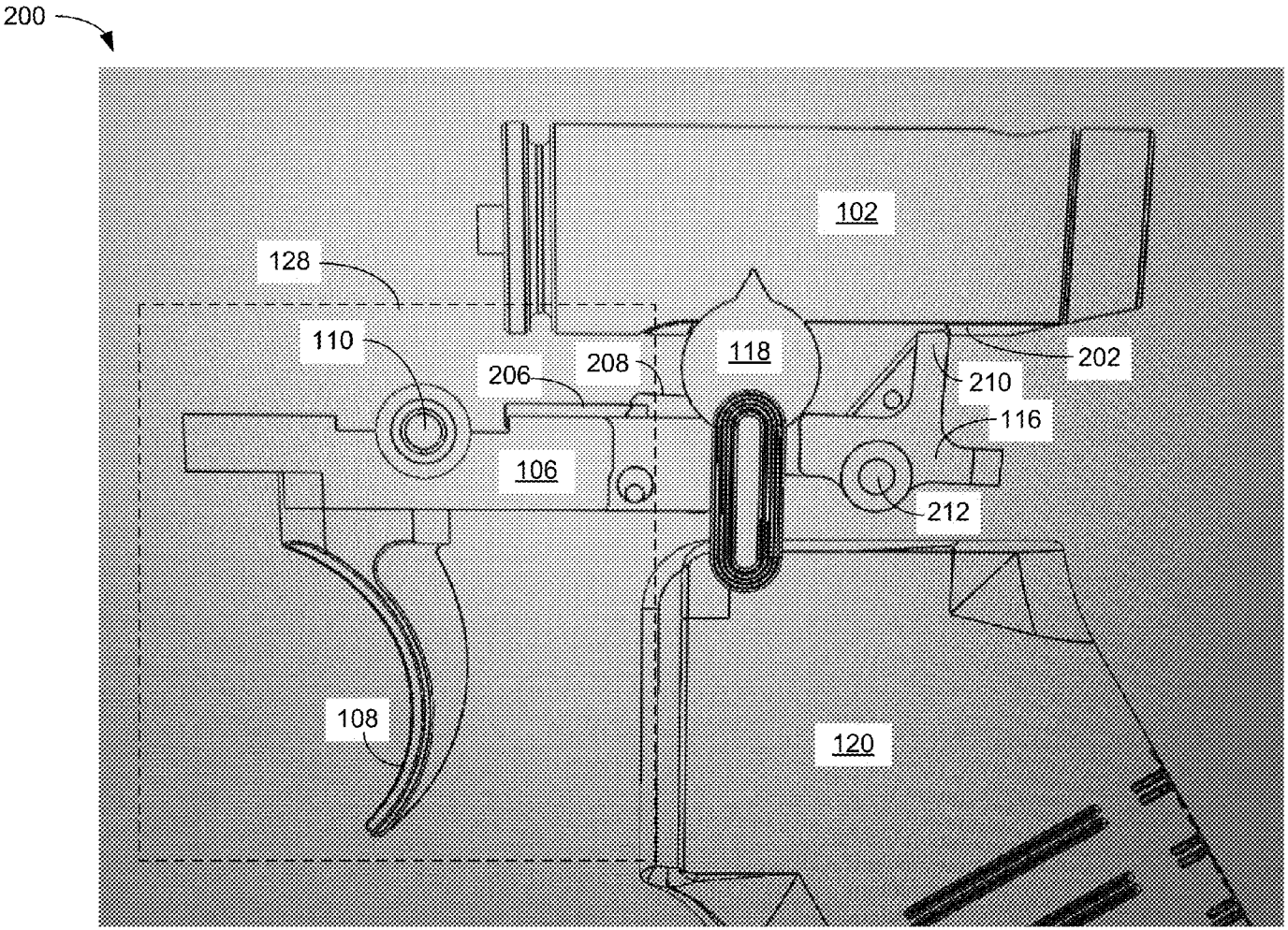
FIG. 2 is diagram illustrating a simplified view of a projectile launcher using a self-resetting trigger mechanism in accordance with one embodiment of the present invention.

FIG. 2 is a diagram 200 illustrating a simplified view of a projectile launcher using a self-resetting trigger mechanism in accordance with one embodiment of the present invention. The launcher, which can be a paintball maker or a firearm, includes striker 102, sear 116, switch 118, and trigger 128, wherein trigger 128 is capable of self resetting independent from the movement of striker 102. Switch 118, in one embodiment, provides multiple optional modes for user to select. For example, optional modes include, but not limited to, training mode, automatic mode, and single mode.

It should be noted the underlying concept of the exemplary embodiment(s) of the present invention would not change if one or more components (or units) were added to or removed from diagram 200.

Striker 102, in one aspect, includes an anchoring notch 202 used for coupling with one end of the sear. Striker 102 can slide between a firing position and a ready-for-firing position within a channel for facilitating the launching of an object. The channel, in one example, can be a bolt situated in the receiver. Depending on the applications, striker 102 is able to slide within a firing channel between the firing position and the ready-for-firing position.

Sear 116, in one example, is structured in an L-shaped or substantially L-shaped sear with a first sear end 210 and a second sear end 208. While first sear end 210 of sear 116 engages with anchoring notch 202 to hold striker 102 to a ready-for-firing position, the second sear end 208 is coupled to an elastic lip 206 of disconnector 106. In one aspect, substantially L-shaped sear 116 includes a sear adjustable component, not shown in FIG. 2, capable of adjusting lever force back to index finger when a squeezing pressure is applied. Sear 116 further includes a sear pin 212 wherein sear 116 pivots around sear pin 212.

Trigger 128 is capable of self resetting independent from the movements of striker 102. In one aspect, trigger 128 contains elastic lip 206 with a ramp and is able to maintain sear 116 in a ready position when elastic lip 206 and second sear end 208 are coupled in a lock position. The lock position, in one example, is when elastic lip 206 is situated beneath second sear end 208. When elastic lip 206 and second sear end 208 are in the lock position, it indicates that the trigger is ready to be retriggered.

The launcher, in one example, includes a firing chamber which is coupled to striker 102. A paintball may be launched in response to the movement of striker 102 traveling from the ready-for-firing position to the firing position of the striker. Alternatively, the launcher may contain a different firing chamber that is able to fire a bullet in response to the movement of striker 102 traveling from the ready-for-firing position to the firing position of the striker.

Figure 3:
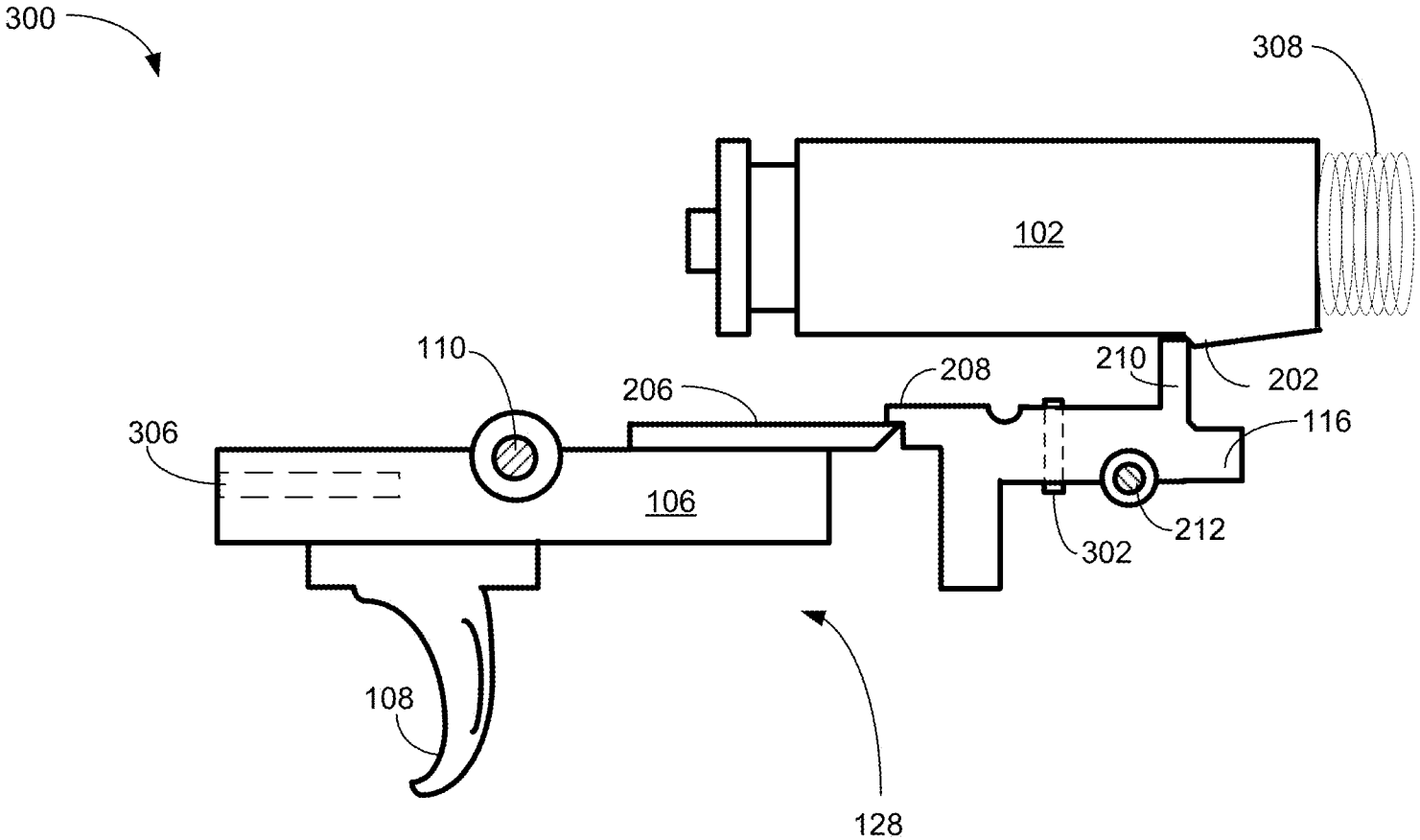
FIG. 3 is a block diagram illustrating an exemplary self-resetting trigger system used within a launcher in accordance with one embodiment of the present invention.

FIG. 3 is a block diagram 300 illustrating an exemplary self-resetting trigger system used within a launcher in accordance with one embodiment of the present invention. Diagram 300, which is similar to diagram 200 except that some components in diagram 200 have been simplified and/or removed, includes striker 102, trigger 128, and sear 116. Striker 102 includes a notch 202 and strike spring 308 capable of powering striker 102 to slide between a firing position and a ready-for-firing position. It should be noted the underlying concept of the exemplary embodiment(s) of the present invention would not change if one or more components (or units) were added to or removed from diagram 300.

Sear 116, in one aspect, can be structured in an L-shaped or substantially L-shaped configuration. Sear 116 includes a first sear end 210, second sear end 208, sear adjustable component 302, and sear pivotal pin 212. While first sear end 210 is configured to engage with striker 102, second sear end 208 is used to interface with trigger 128. Striker 102 can be held at the ready-for-firing position when first sear end 210 engages with anchoring notch 202 of striker 102. Sear adjustable component 302, in one embodiment, provides creep adjustment. The creep associated with the trigger can be adjusted to imitate the creep of a rifle such as a triggering system of M16.

Trigger 128, which is able to reset independent from the kinetic movement of striker 102, includes a lever 108, trigger pin 110, and disconnector 106. Disconnector 106 further includes elastic lip 206 and calibrator 306. Elastic lip 206 is mounted on or within disconnector 106 wherein elastic lip 206 is configured to be directional flexible or retractable. One surface of elastic lip 206 is also shaped as a ramp with slop used for self resetting.

Elastic lip 206, as illustrated in diagram 300, is in a locked position with second sear end 208 since second sear end 208 is on top of elastic lip 206. A locked position refers to an engagement between second sear end 208 and elastic lip 206 to maintain sear 116 in a ready position. In one embodiment, elastic lip 206 is able to retract in a direction parallel to disconnector 106.

Calibrator 306, in one embodiment, is used to provide a setting function configured to calibrate takeup associated with lever 108. Calibrator 306, in one example, is structured to include a screw which allows a user to turn the screw based on a desirable takeup associated with lever 108. For example, takeup of lever 108 can be calibrated by adjusting calibrator 306 to mimic takeup of a semiautomatic rifle.

Takeup can be referred to as the initial "slack" occurred in a trigger system. The takeup in a paintball gun is generally different from the takeup of a rifle. With calibrator 306, the takeup in the paintball gun can be adjusted to imitate the takeup of a real rifle or M16 rifle.

Creep occurs after the initial takeup during the process of pulling or squeezing a trigger such as lever 108. For example, when the trigger or lever is pulled after passing takeup, the finger feels force feedback due to the resistance of sear 116 and striker 102. Upon applying sufficient amount of pressure, sear 116 breaks off from disconnector 106 and an object is launched. Creep, in one example, is the resistance or force feedback or force back of the mechanical interconnection before disconnection between sear 116 and disconnector 106.

An advantage of using calibrator 306 and sear adjustable component 302 is that they can be calibrated to imitate trigger 128 as a rifle or automatic machine gun.

Figure 4:
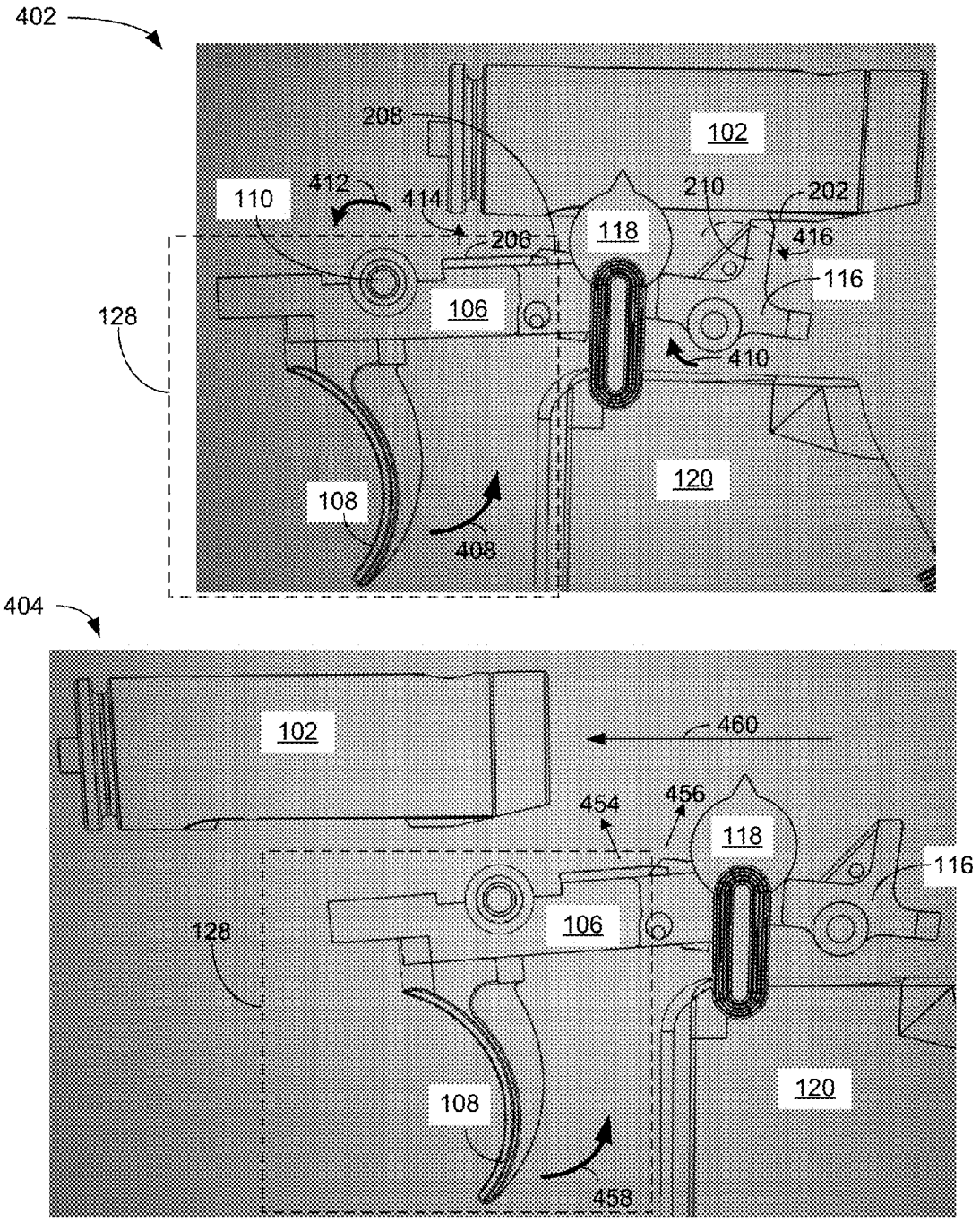
FIGS. 4-6 are diagrams illustrating a process of releasing a striker using the self-resetting trigger system in accordance with one embodiment of the present invention.
Figure 5:
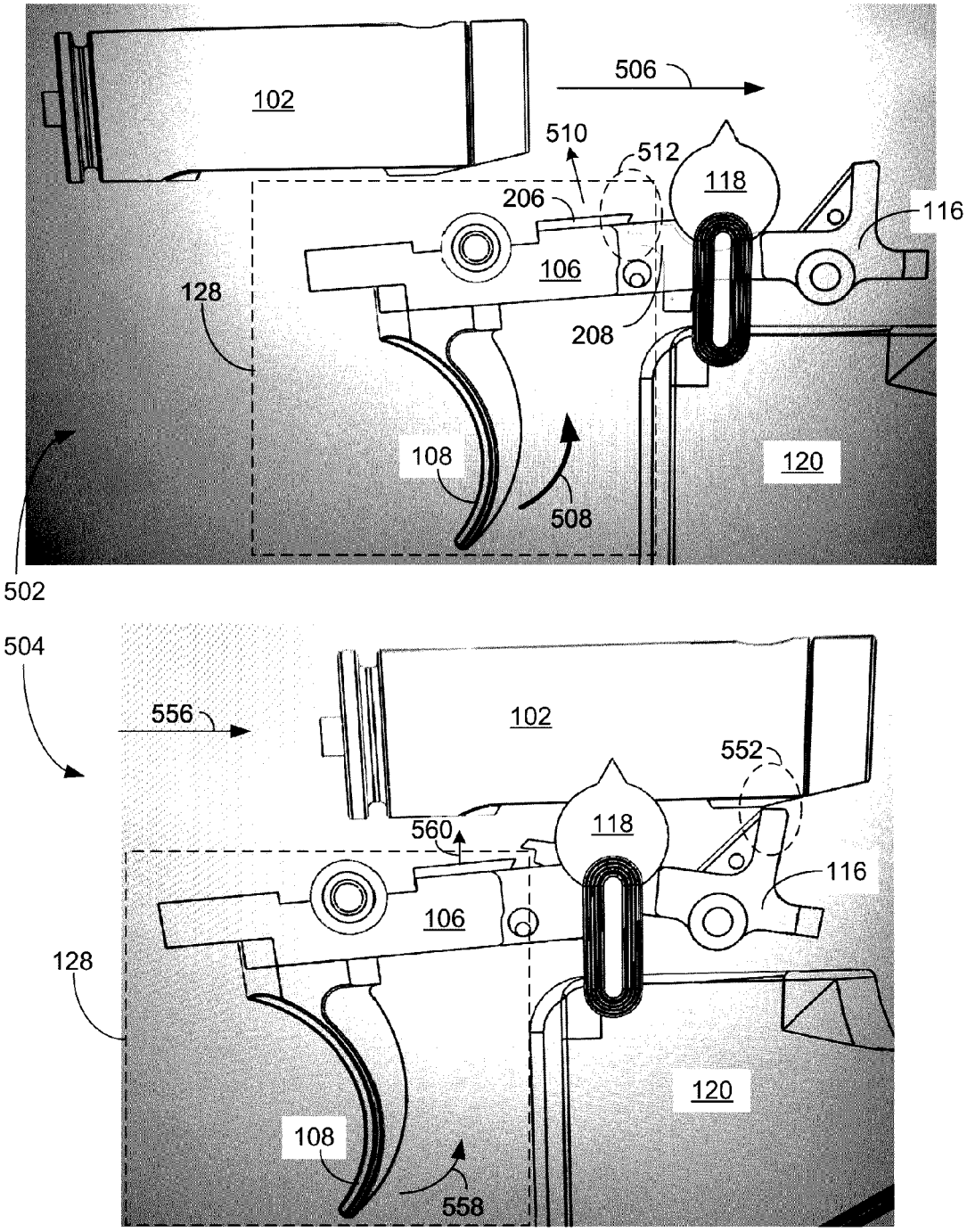
Figure 6:
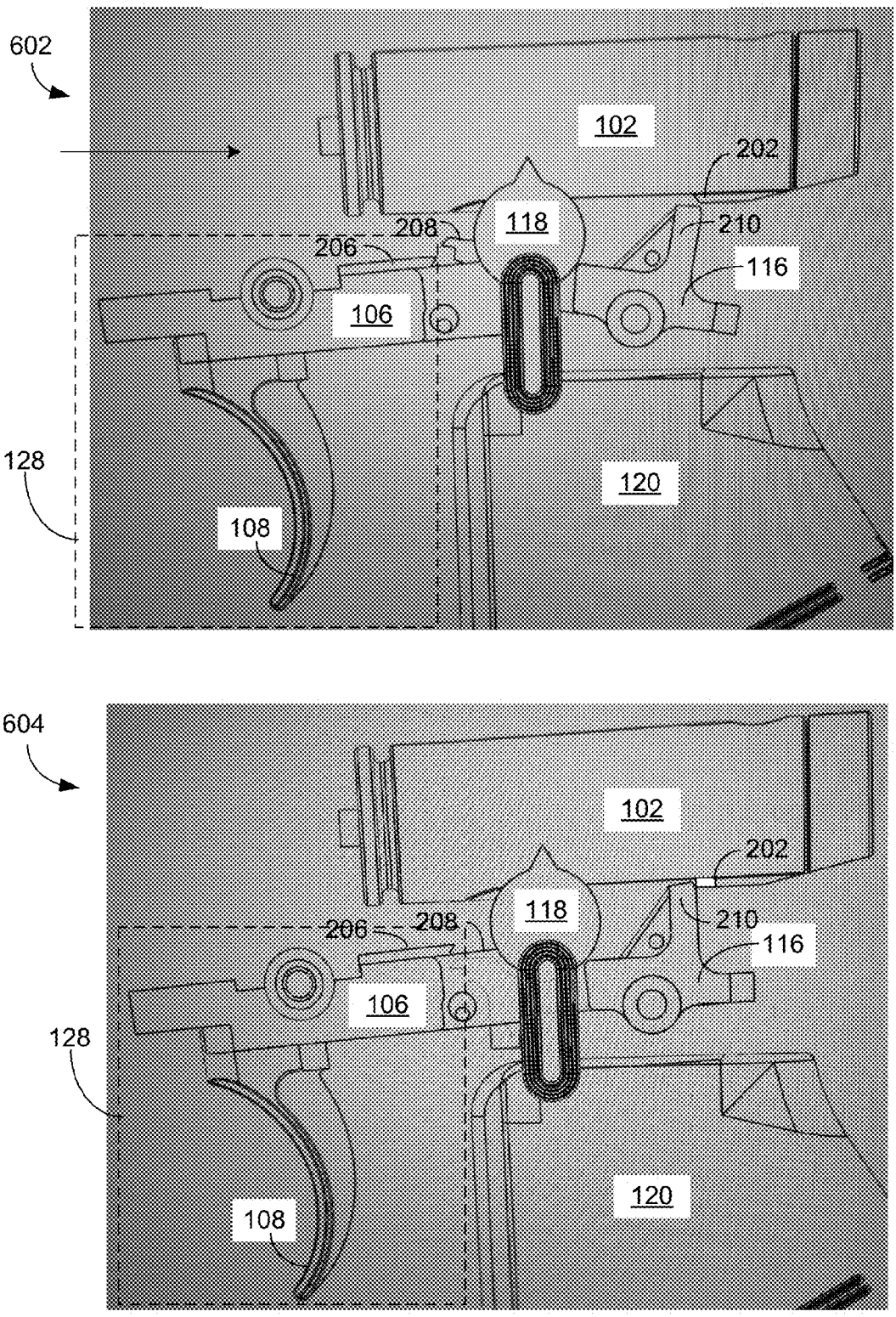

FIGS. 4-6 show a set of diagrams 402-404, 502-504, and 602-604 illustrating a process of releasing a striker using a self-resetting trigger system in accordance with one embodiment of the present invention. Diagram 402, which is similar to diagram 200 in FIG. 2, includes striker 102, sear 116, switch 118, and trigger 128, wherein trigger 128 is able to self reset independent from movements of sear 116 and striker 102. Switch 118, in one embodiment, provides multiple optional modes for user to select a desirable operation mode. For example, optional modes include, but not limited to, training mode, automatic mode, and single mode. It should be noted the underlying concept of the exemplary embodiment(s) of the present invention would not change if one or more components (or units) were added to or removed from diagram 400.

Trigger 128, for example, is able to change orientation of sear 116 causing striker 102 to be released. After cocking of striker 102, a process of trigger resetting takes place. In one aspect, the reset of trigger 128 is independent from the cycling of striker 102 or hammer. Because of resetting trigger 128 is independent from the cycling or movement of striker 102, operation of training mode is simplified.

During operation, lever 108 is pulled by an index finger in a direction as indicated by arrow 408. When pulling pressure 408 is applied to lever 108, disconnector 106 begins to pivot around trigger pin 110 as indicated by arrow 412. When disconnector 106 pivots, elastic lip 206 lifts second sear end of sear 116 which causes sear 116 to pivot around sear pivotal pin. When sear 116 pivots in a direction indicated by arrow 410, first sear end 210 moves in a direction indicated by numeral 416. When first sear end 210 shifts in a direction indicated by numeral 416, first sear end 210 begins to release striker 102 as first sear end 210 moves away from anchoring notch 202.

Diagram 404 illustrates a release of striker 102 when sear 116 disconnects from striker 102. When lever 108 is pulled in a direction indicated by arrow 458, elastic lip moves in a direction indicated by numeral 454. With elastic lip moves in a direction indicated by numeral 454, second sear end of sear 116 shits in a direction indicated by numeral 456 in response to the lift of elastic lip. Once the first sear end of sear disconnects from the anchoring notch of striker 102, striker 102 is released and it moves in a direction as indicated by arrow 460. It should be noted that moving speed of striker 102 is faster than the reflection of pulling speed generated by the index finger.

Diagrams 502-504 illustrate a launch process in which the cycling speed of striker 102 is faster than the pulling or squeezing speed generated by a finger. The cycling of striker 102 includes moving from the cocked (ready-for-firing) position to the firing position and then moving back to the cocked position. As illustrated in diagram 502, lever 108 of trigger 128 is continuously squeezed as indicated by arrow 508 while striker 102 moves back after an object has been launched. As striker 102 moves in a direction indicated by arrow 506, elastic lip 206 continues to move up as indicated by arrow 510 which disconnects from the second sear end of sear 116 as indicated by numeral 512. When elastic lip 206 disconnects from the second sear end of sear 116 due to application of pulling pressure indicated by arrow 508, the second sear end of sear 116 moves underneath of elastic lip 206 as indicated by numeral 512.

While striker 102 continues moving in a direction as indicated by arrow 556 toward the cocking position as shown in diagram 504, lever 108 may or may not be pulling depending on the users. It should be noted that if the squeezing pressure to lever 108 continues as indicated by arrow 558, the elastic lip on disconnector 106 continues moving in a direction indicated by arrow 560. It should be noted that the anchoring notch of striker 102 begins to engage with the first sear end of sear 116 as indicated by numeral 552.

Diagram 602 illustrates the anchoring notch of striker 102 passing first sear end 210 of sear 116 and then striker 102 is held by first sear end 210 when anchoring notch 202 of striker 102 catches first sear end 210 as shown in diagram 602. When striker 102 is held at the cocked position, trigger 128 has not been reset yet since elastic lip 206 is still on the top of second sear end 208 of sear 116 as shown in diagram 604.

Figure 7:
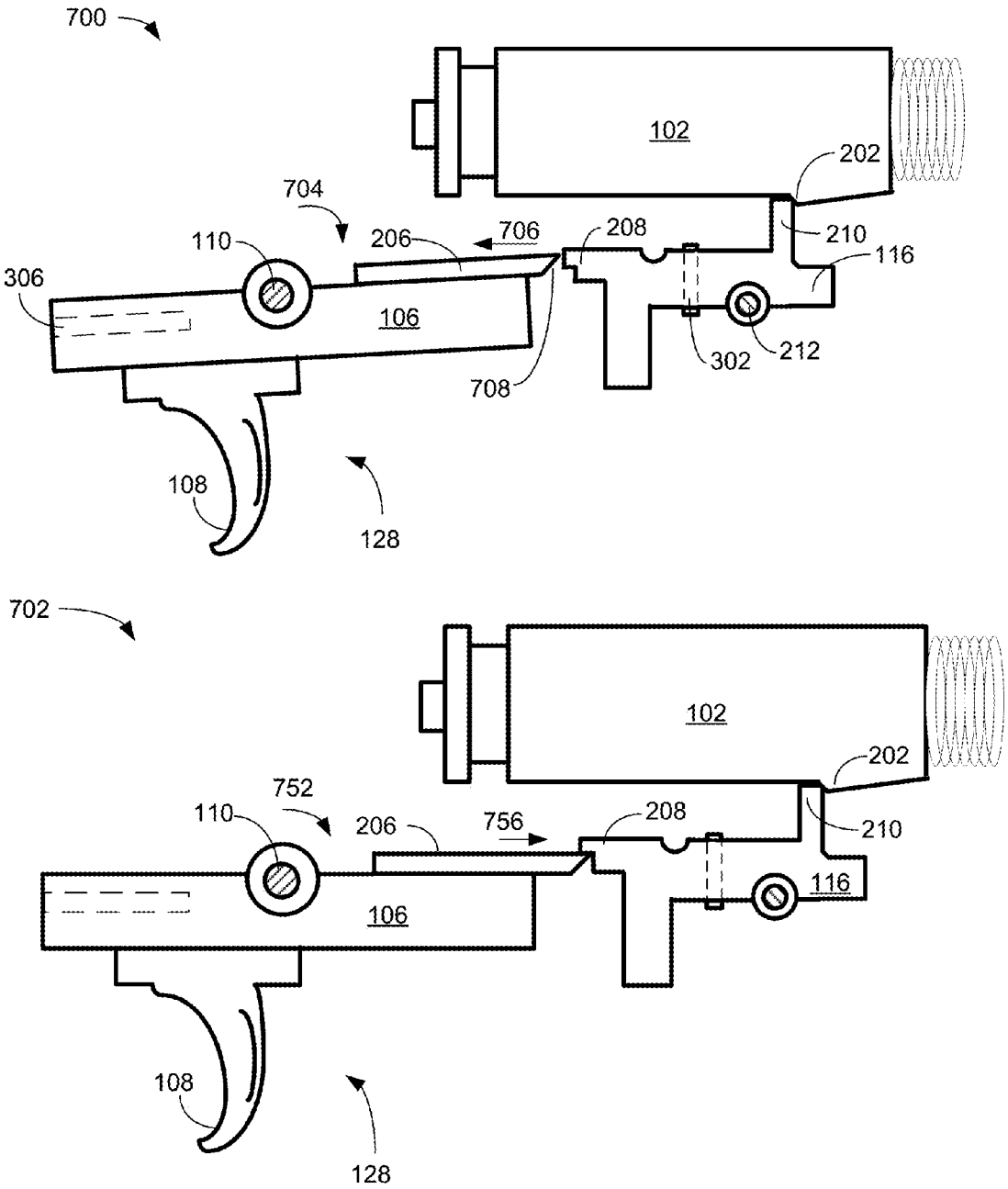
FIG. 7 shows block diagrams illustrating a process of self-resetting trigger using an elastic lip in accordance with one embodiment of the present invention.

FIG. 7 shows block diagrams 700-702 illustrating a process of self-resetting trigger using an elastic lip in accordance with one embodiment of the present invention. Diagram 700, which shows a process that continues after the process shown in diagram 604, illustrates a process of resetting trigger 128. In one embodiment, disconnector 106 of trigger 128, which may be powered by a spring not shown in FIG. 7, begins to pivot around trigger pin 110 in a direction as indicated by arrow 704. Ramp 708 of elastic lip 206 contacts second sear end 208 of sear 116. With the pushing pressure generated by pivotal motion of disconnector 106 as indicated by arrow 704, elastic lip 206 begins to retract in a direction indicated by arrow 706 with the contact of ramp 708. When elastic lip 206 moves below second sear end 208 of sear 116 as shown in diagram 702, elastic lip 206 extends its tip in a direction indicated by arrow 756 whereby a lock position is established. Trigger 128 is ready for the next launch.

Figure 8:
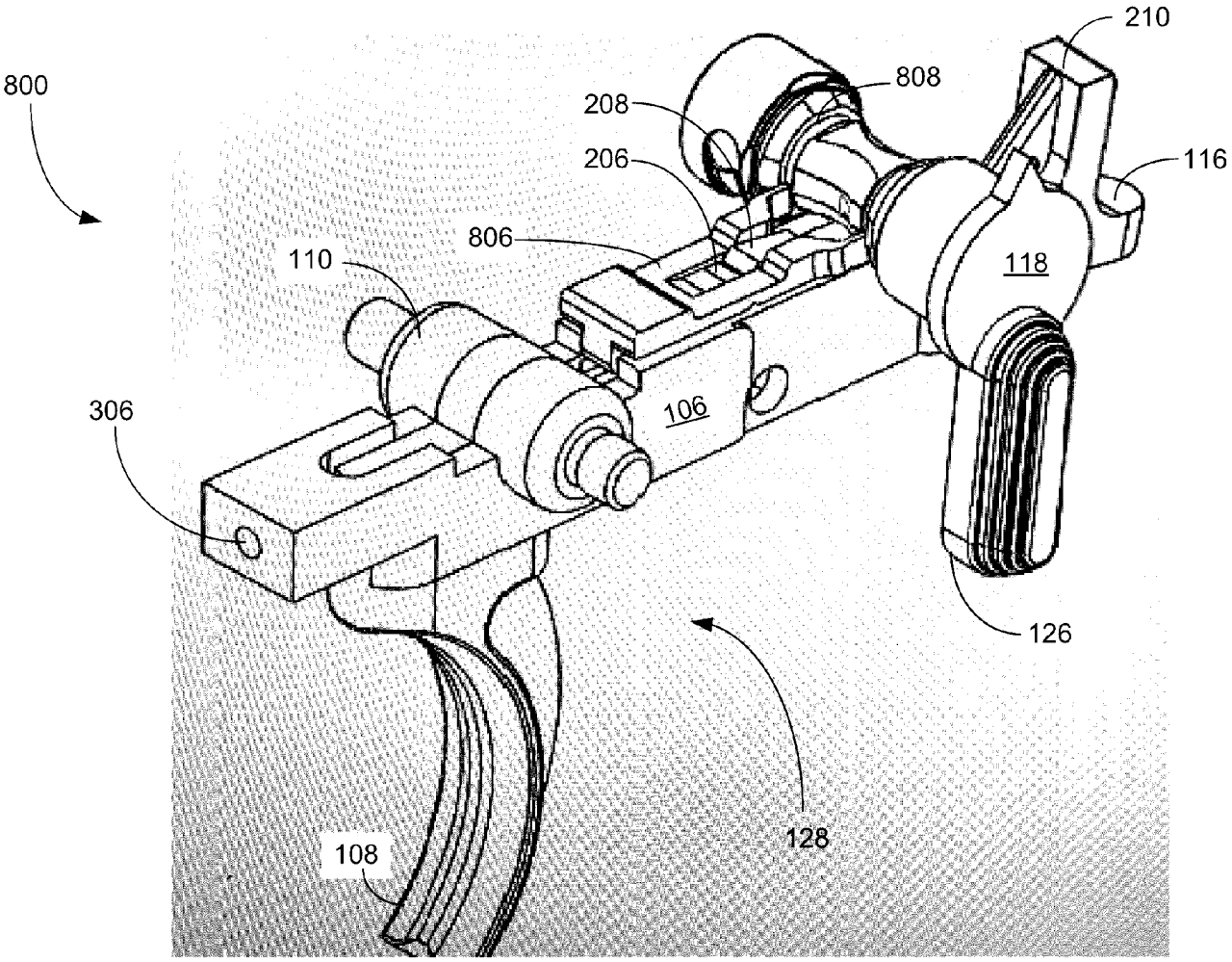
FIG. 8 is a three-dimensional ("3D") diagram illustrating a self-resetting trigger system with a switch in accordance with one embodiment of the present invention.

FIG. 8 is a three-dimensional ("3D") diagram 800 illustrating a self-resetting trigger system with a switch in accordance with one embodiment of the present invention. Diagram 800 illustrating several components of a launcher includes switch 118, sear 116, and trigger 128. Switch 118 includes a handle 126 and cam 808. In one aspect, switch 118 is configured to use cam 808 to provide an automatic mode. It should be noted the underlying concept of the exemplary embodiment(s) of the present invention would not change if one or more components (or units) were added to or removed from diagram 800.

A launcher is capable of providing an automatic mode for launching objections continuously as long as lever 108 is pulled. The launcher, in one aspect, includes a trigger 128, switch 118, and sear 116. In one example, the launcher also include a striker, not shown in FIG. 8, is able to slide between a firing position and a cocked position for launching an object. Sear 116, having a first sear end and a second sear end, is able to hold the striker to a ready-for-firing position when the first sear end of sear 116 engages with an anchoring notch of the striker.

Trigger 128, capable of self resetting independent from the movement of the striker, includes lever 108, trigger pin 110, disconnector 106, and mode bar 806. In one embodiment, trigger 128 is able to maintain sear 116 in a ready position when elastic lip 206 of trigger 128 and second sear end 208 of sear 116 are coupled in a lock position. The operation and/or tactile sensation associated with trigger 128, in one aspect, can be adjusted to imitate trigger operation or tactile sensation of triggering of a rifle when switch 118 is set to a rifle mode. Alternatively, trigger 128 can be adjustable to imitate trigger operation of a semi-automatic firearm when switch 118 is set to a semi-automatic mode. Mode bar 806, in one embodiment, is used to extend the connection from a trigger disconnector or disconnector 106 to switch 118. For example, mode bar 806 is able to engage with cam 808 of switch 118 for facilitating mode selections.

Switch 118 includes multiple settings for mode selections. For example, switch 118 disconnects the striker from sear 116 when the training mode is selected. A benefit of disconnecting the striker from sear 116 is that the cycling of the striker is not necessary to resetting trigger 128 since trigger 128 can reset itself. For example, cycling the striker is not required for a user to practice triggering accuracy for reduce "jerks" and/or "slaps". Cam 808 of switch 118 further includes an automatic selection and a rifle selection. When an automatic mode is selected, cam 808 of switch 118 sets elastic lip 206 to a predefined orientation which maintains sear 116 in a released position as long as lever 108 of trigger 128 is in a pulled position.

Figure 9A:
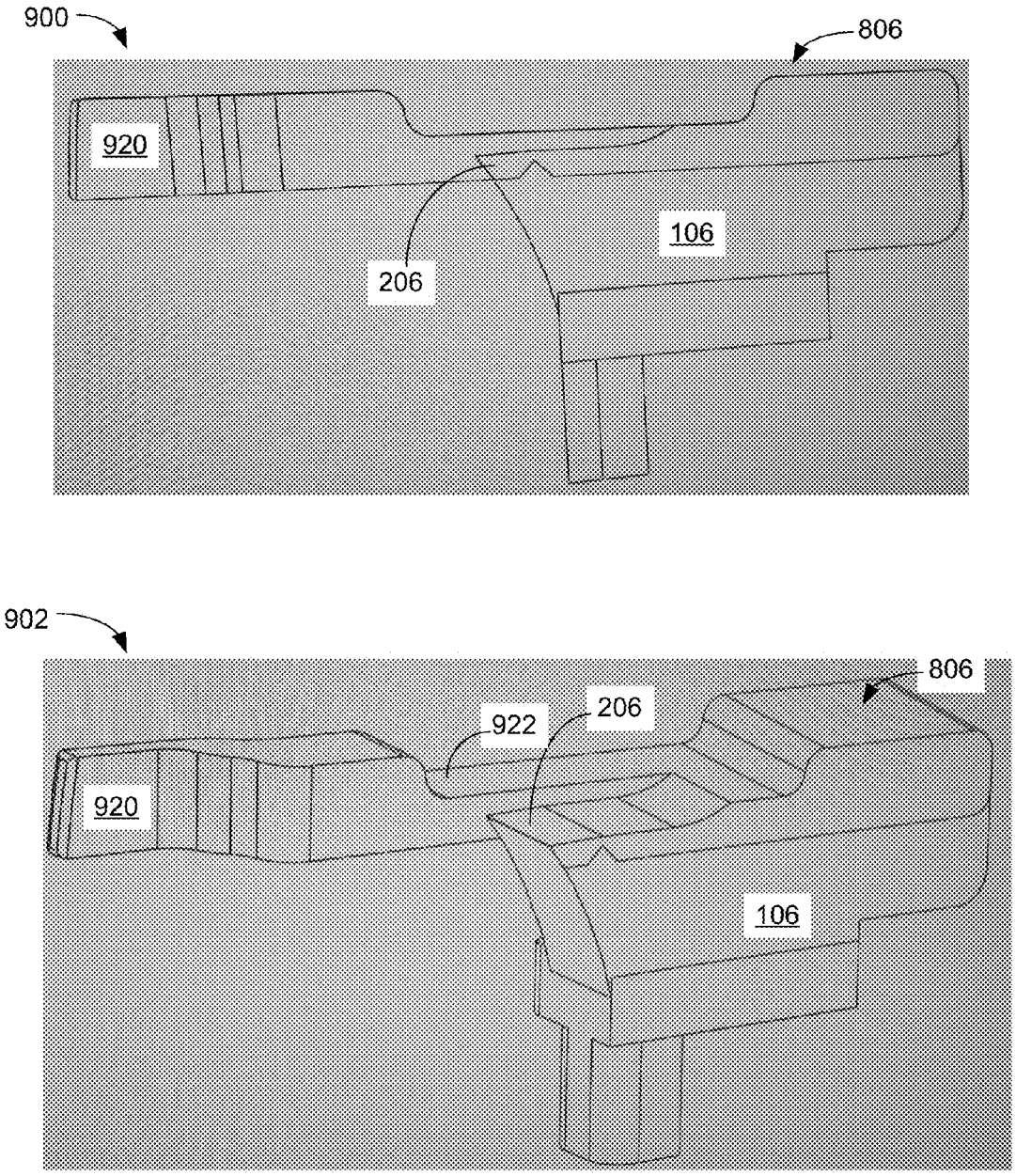
FIGS. 9A-C are diagrams illustrating a paintball launcher able to launch objects in automatic mode using a self-resetting trigger mechanism in accordance with one embodiment of the present invention.
Figure 9B:
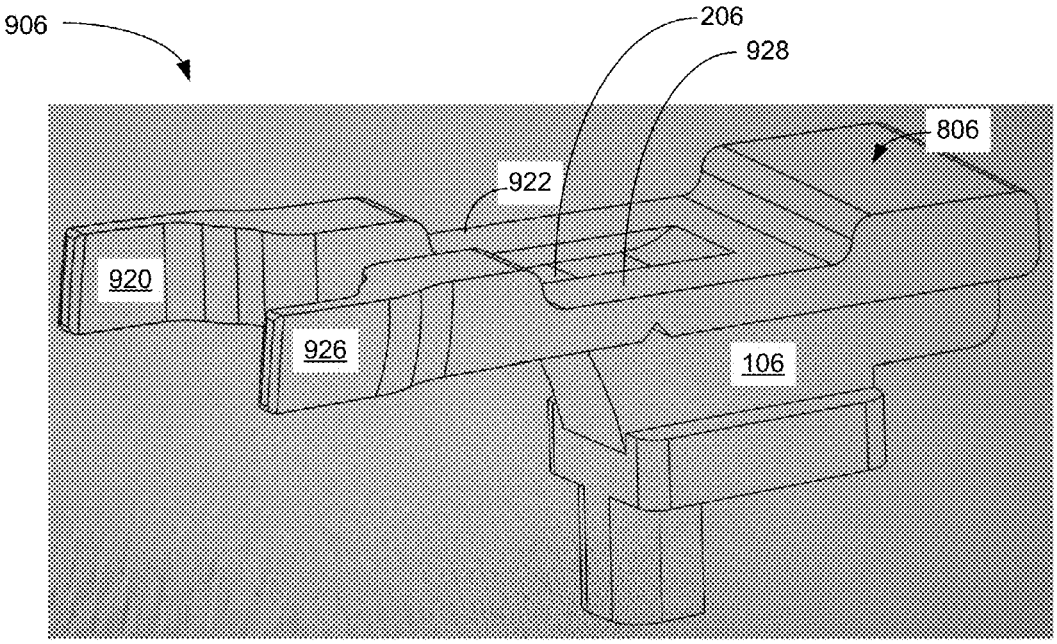
Figure 9B:
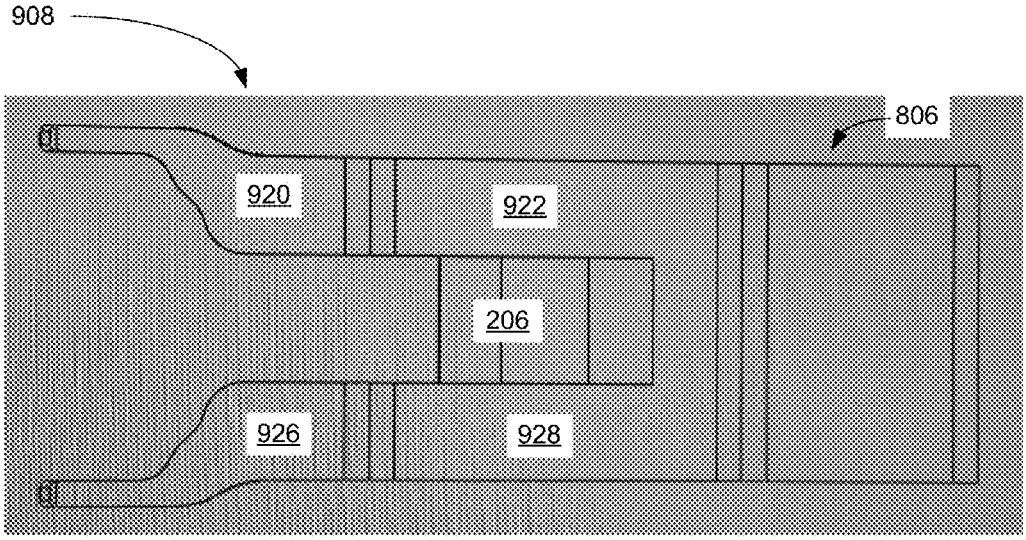
Figure 9C:
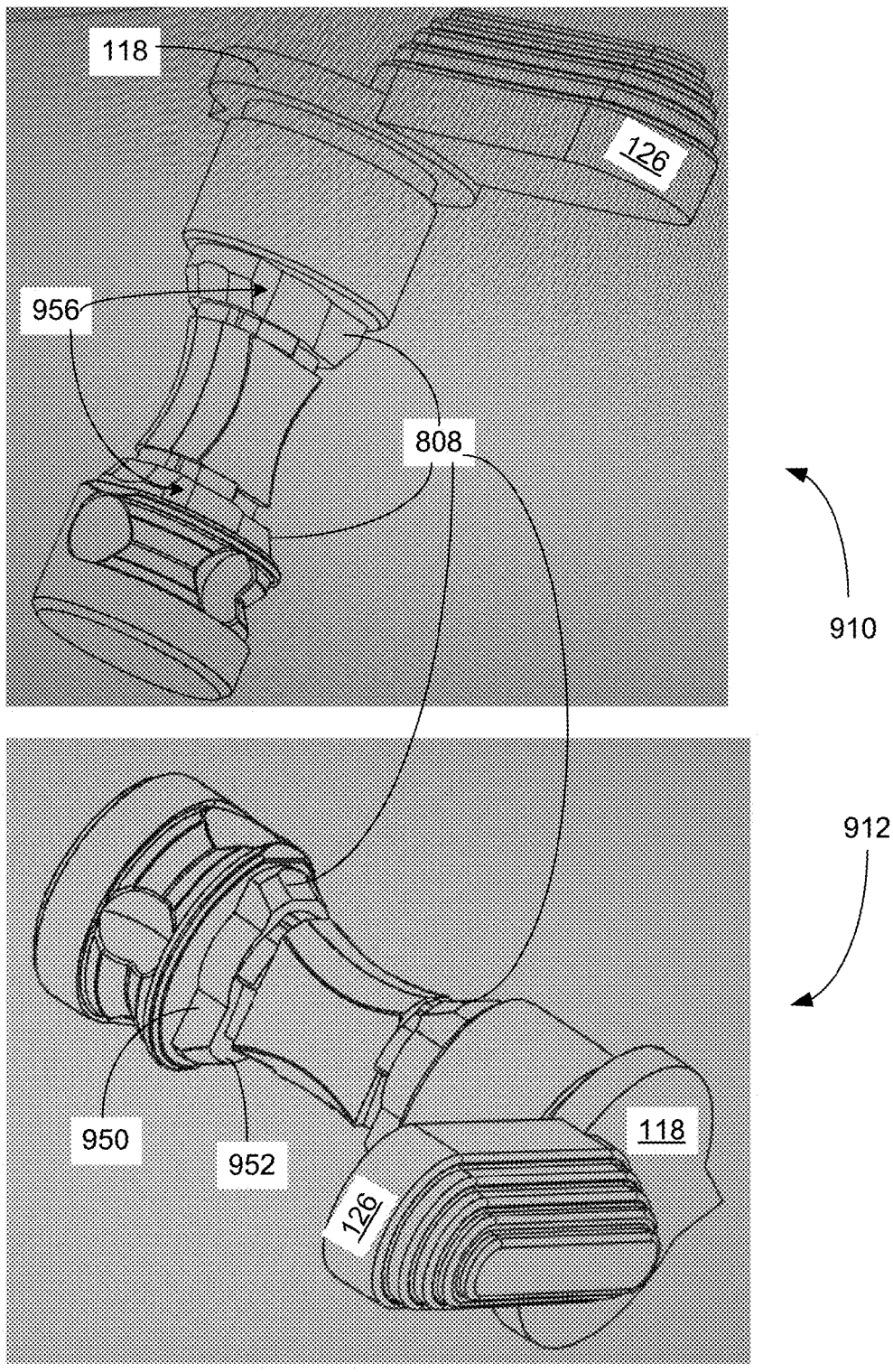

FIGS. 9A-C are diagrams 900-912 illustrating a paintball launcher able to launch objects in an automatic mode using a self-resetting trigger mechanism in accordance with one embodiment of the present invention. Diagram 900 illustrates a cross-section view of mode bar 806 which is coupling to disconnector 106 and elastic lip 206. Mode bar 806, in one embodiment, includes at least one cam bar 920 used to interface with the cam of switch. Diagram 902 is a 3D diagram illustrating mode bar 806 with a single cam bar 920. Cam bar 902, in one example, is a tip portion of extension 922 extended from mode bar 806. It should be noted that elastic lip 206 is retractable for self resetting.

Diagrams 906-908 of FIG. 9B illustrate mode bar 806 with two cam bars 920 and 926. Diagram 906 shows a 3D view of mode bar 806 coupled to disconnector 106 and elastic lip 206. Mode bar 806 includes two cam bars 920 and 926 with extensions 922 and 928, respectively. Diagram 908 is a top view diagram of mode bar 806 coupled to disconnector 106 with cam bars 920 and 926 extending from extensions 922 and 928. An advantage of having cam bars is that two cam bars have a more efficient coupling interface between the cam bars and the cam of switch for mode selections.

FIG. 9C shows a switch 118 with two different views. Diagram 910 illustrates switch 118 with handle 126 and contains two cams 808 wherein each cam 808 has multiple cutouts 956 used to interface with cam bars for mode selections. Diagram 912 illustrates cam 808 having two cutouts 950-952. Cutout 950 is an auto-cutout for automatic selection and cutout 952 is a single cutout for single action selection. It should be noted that configurations of switch 118 and cam 808 show in FIG. 9C are described herein as illustrations and they should not be viewed as limitations. Different configurations and designs are possible to achieve similar functions.

Figure 10:
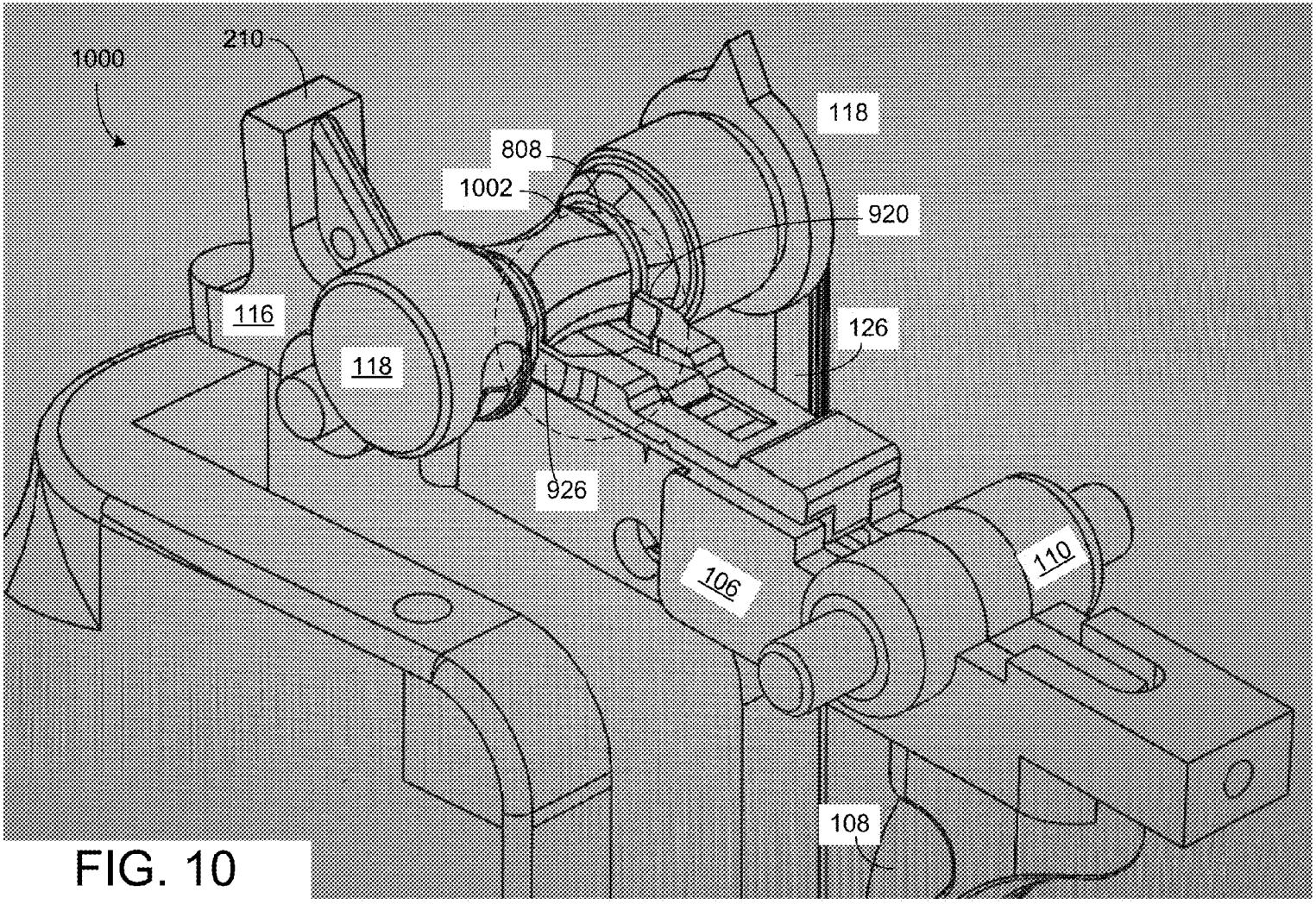
FIGS. 10-13 are diagrams illustrating an exemplary launcher structure using a cam to control operating modes in accordance with one embodiment of the present invention.
Figure 11:
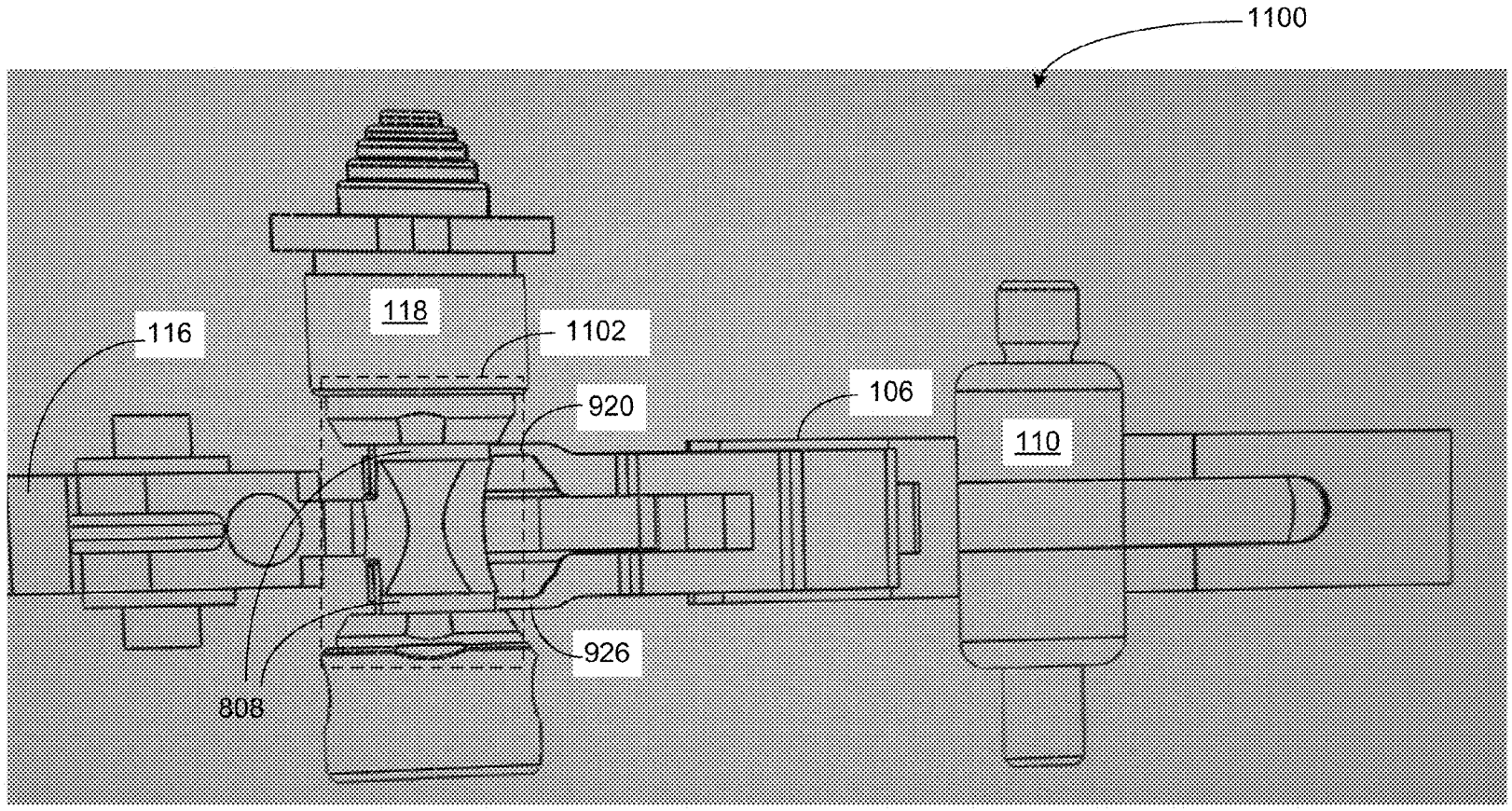
Figure 12:
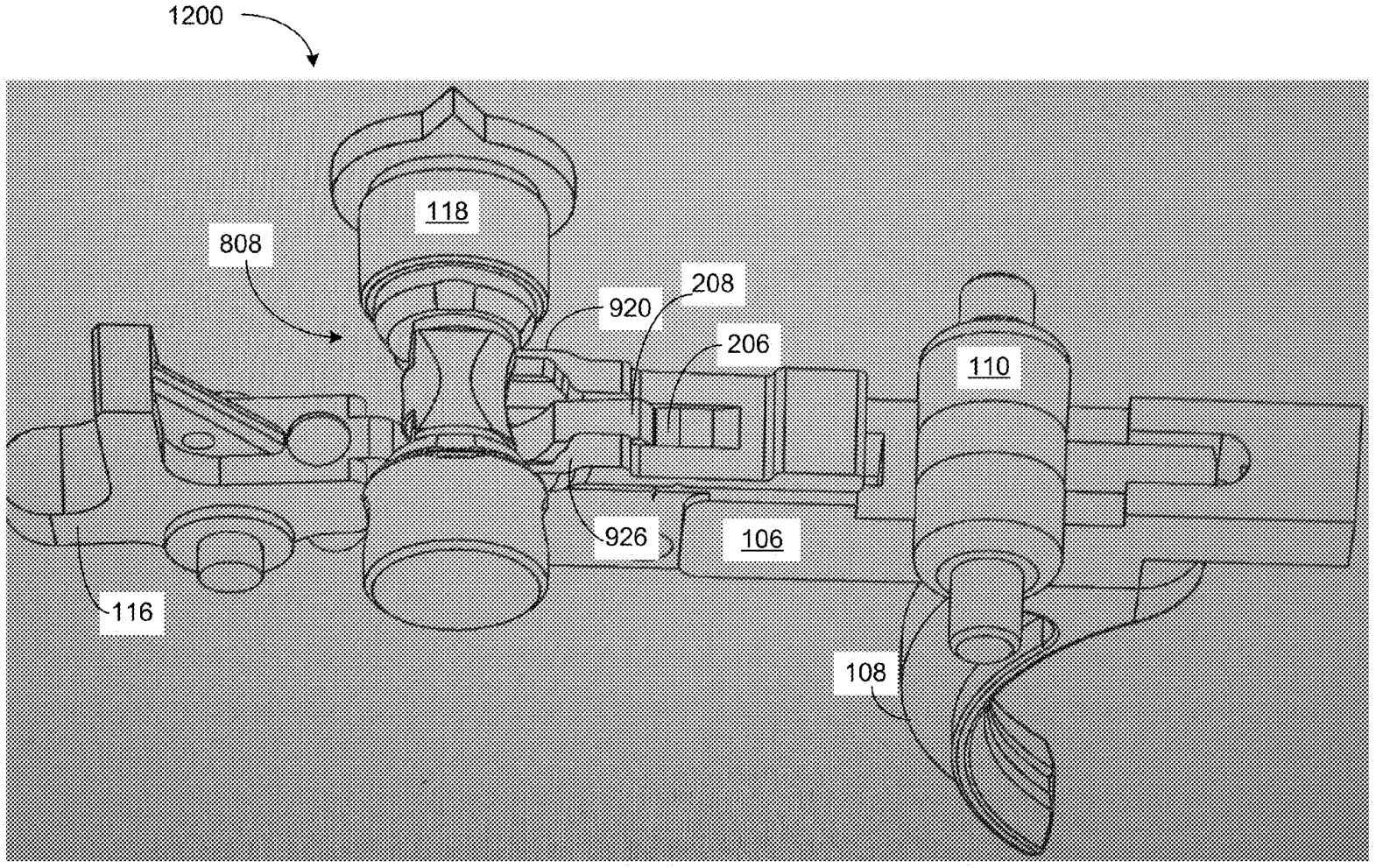
Figure 13:
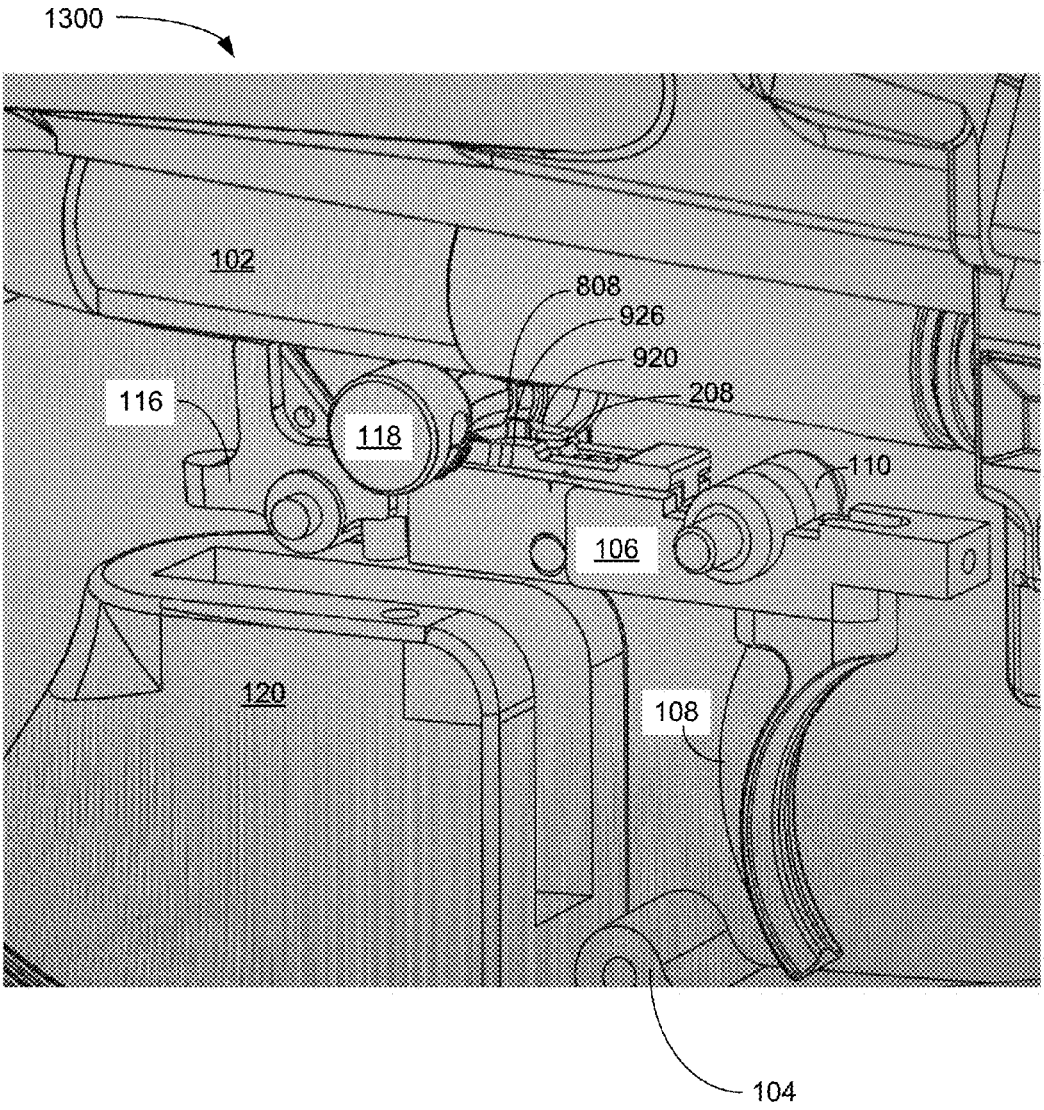

FIGS. 10-13 are diagrams illustrating an exemplary launcher using a cam to control operating modes in accordance with one embodiment of the present invention. FIG. 10 is a 3D diagram 1000 illustrating how cam 808 engages with cam bars 920-926 of the mode bar. In one example, cam bars 920-926 are in contact with cam 808 as indicated by numeral 1002 to operate the launcher in the automatic mode. FIG. 11 illustrates a top view diagram 1100 showing inter-coupling between cam bars 920-926 with cam 808. FIG. 12 is a 3D top view diagram 1200 showing inter-coupling between cam bars 920-926 and cam 808. FIG. 13 is a 3D diagram 1300 showing a side view of inter-coupling between cam 808 and cam bars 920-926.

Figure 14:
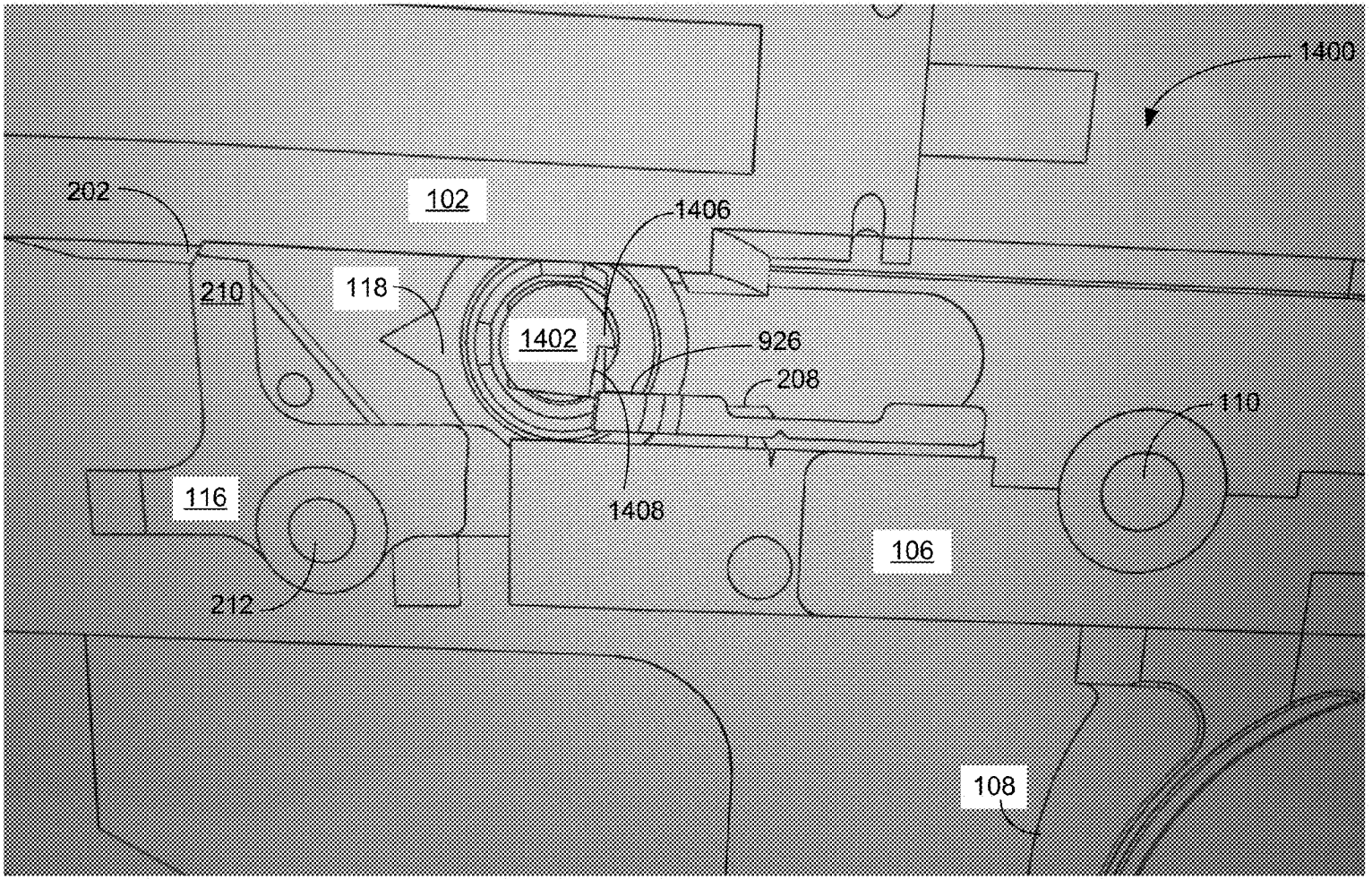
FIGS. 14-16 are diagrams illustrating an automatic mode using a self-resetting trigger system in accordance with one embodiment of the present invention.
Figure 15:
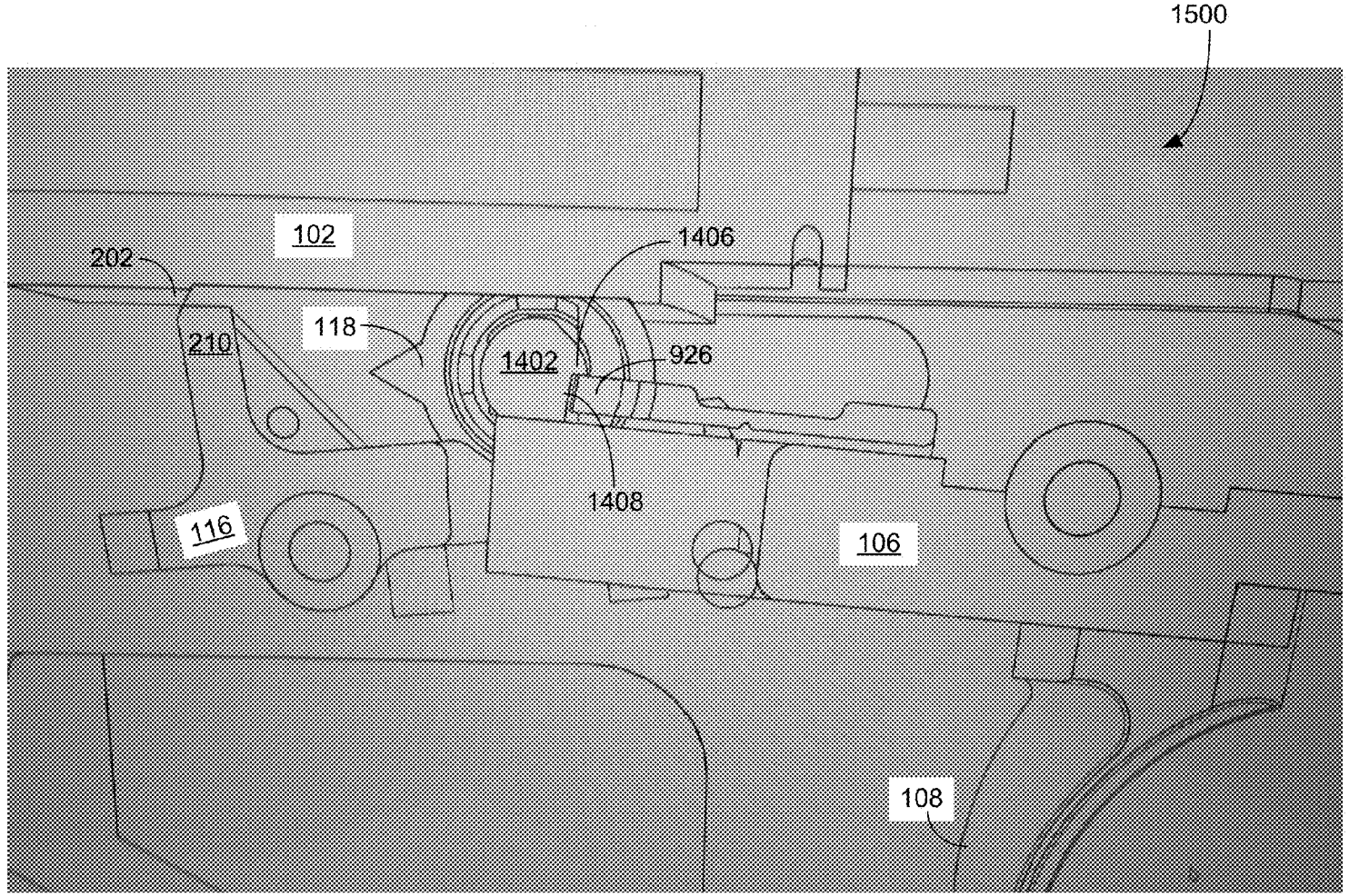
Figure 16:
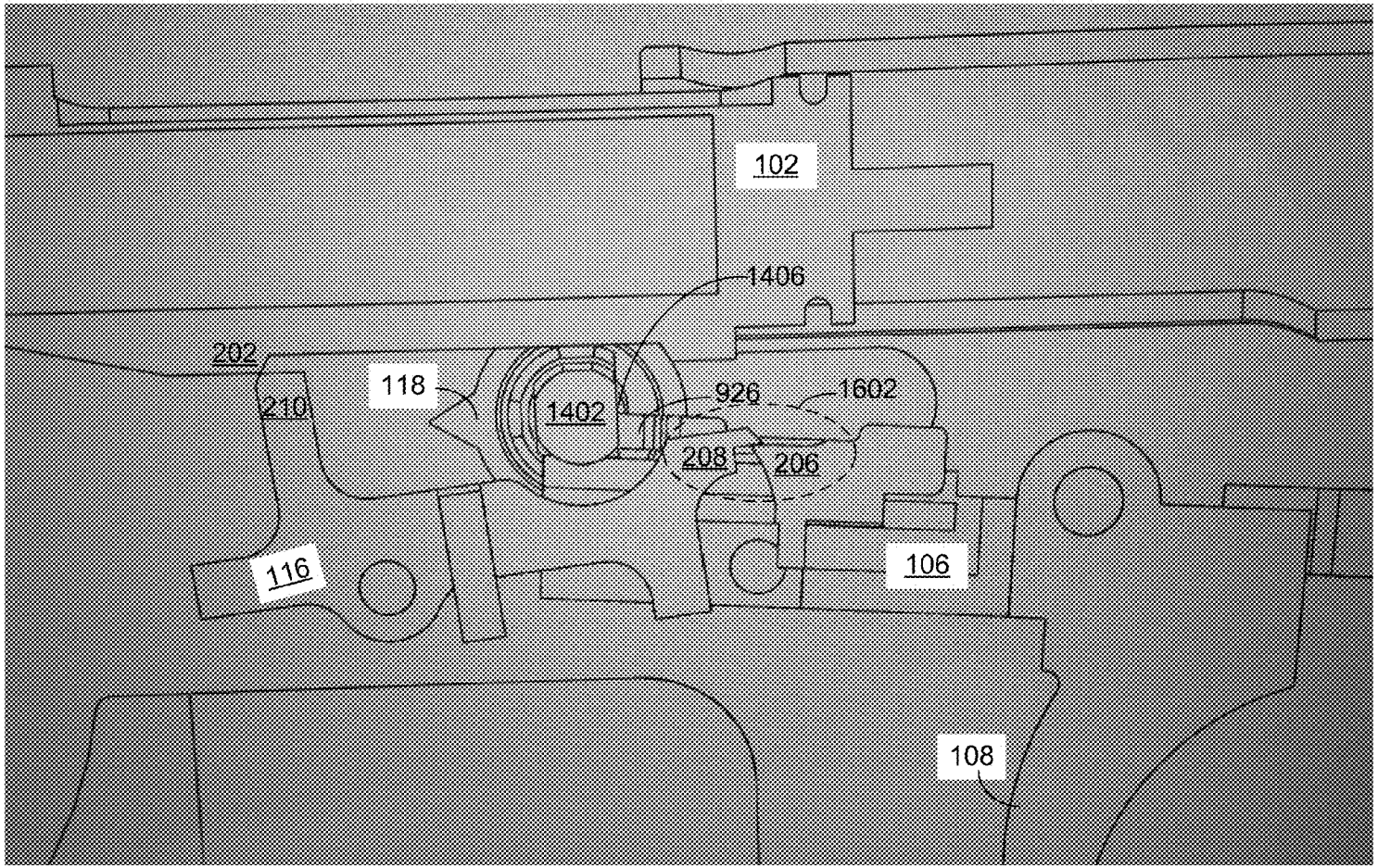

FIGS. 14-16 are diagrams illustrating an automatic mode using a self-resetting trigger system in accordance with one embodiment of the present invention. FIG. 14 is a cross-section view diagram 1400 which includes a trigger, striker 102, sear 116, switch 118, and disconnector 106, wherein the trigger is capable of self resetting. Switch 118, in one embodiment, provides multiple optional modes for user to select. For example, optional modes include, but not limited to, training mode, automatic mode, and single mode. It should be noted the underlying concept of the exemplary embodiment(s) of the present invention would not change if one or more components (or units) were added to or removed from diagram 1400.

Switch 118 includes a cam 1402 with a stopper 1406 adjacent to a cutout 1408. In one embodiment, switch 118 is switched to an automatic mode as showing in diagram 1400. Before lever 108 is squeezed, cam bar 926 is not engaged with cam 1402. It should be noted that second sear end 208, in one aspect, is situated on top of the elastic lip, not shown in FIG. 14, whereby a lock position is maintained.

FIG. 15 is a cross-section diagram 1500 showing lever 108 has been continuously squeezed. When lever 108 is squeezed or pulled, elastic lip lifts sear 116 allowing first sear end 210 to release striker 102. While lever 108 is pulled, cam bar 926 moves into cutout 1408 and is stopped moving upward due to stopper 1406. When elastic lip maintains sear 116 in the released orientation while stopper 1406 prevents cam bar 926 to move up, striker 102 continuously cycles or moves as long as lever 108 is pulled. Continuously cycling of striker 102 indicates continuously firing where by an automatic firing is achieved.

FIG. 16 is a cut-open sectional view 1600 showing elastic lip 206 pushes second sear end 208 of sear 116 to maintain sear 116 to a released position. In one aspect, because of stopper 1406, elastic lip 206 stays below second sear end 208 whereby an automatic firing operation can be achieved as indicated by numeral 1602. As long as lever 108 is maintained in a pulled position, the released position of sear 116 is maintained. The released position of sear 116 means that sear 116 is disconnected from striker 102 while elastic lip 206 remains underneath second sear end 208 of sear 116.

Figure 17:
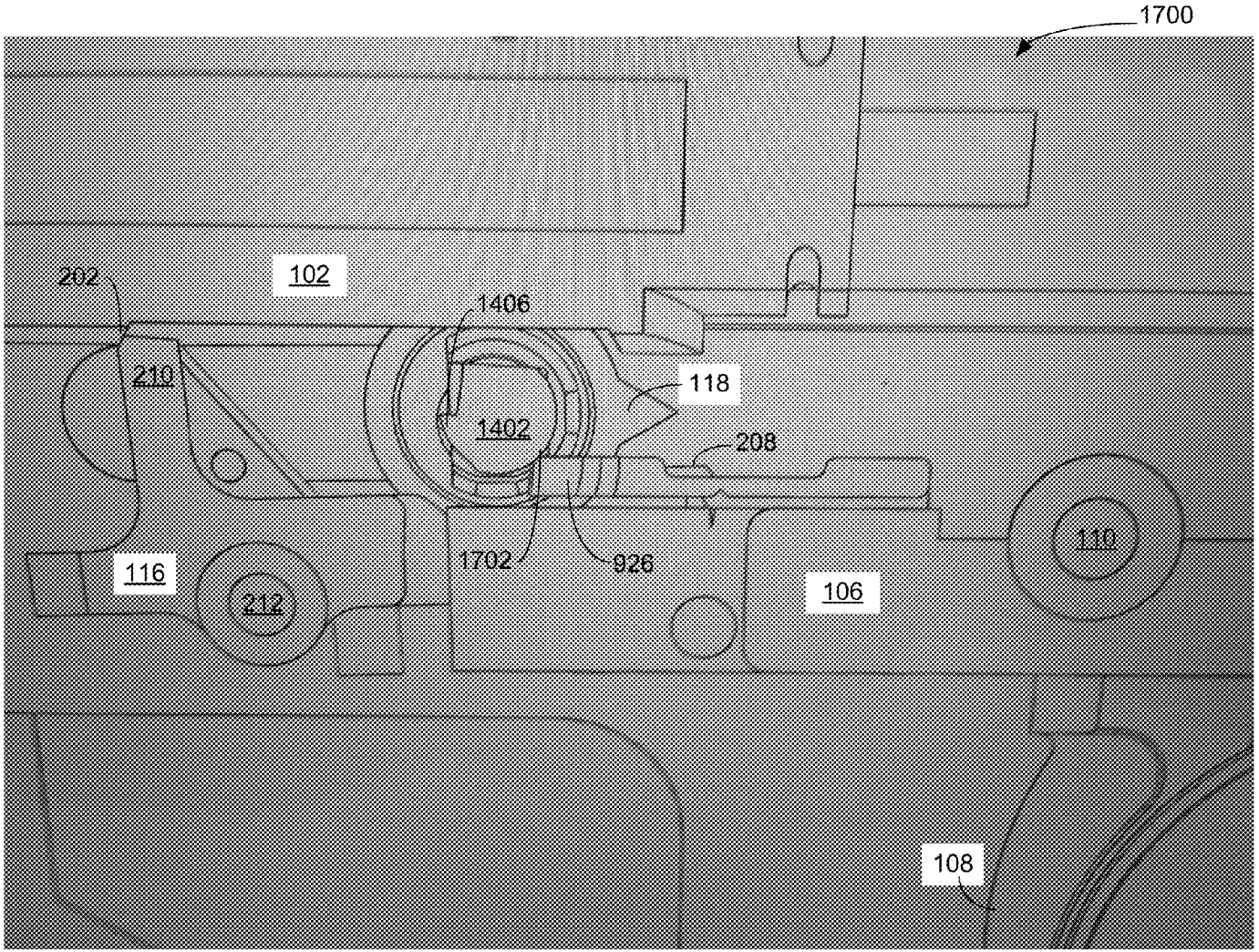
FIG. 17 is a cross-section diagram illustrating a single mode operation using a self-resetting trigger system in accordance with one embodiment of the present invention.

FIG. 17 is a cross-section diagram 1700 illustrating a single mode operation using a self-resetting trigger system in accordance with one embodiment of the present invention. When switch 118 is selected to a single operational mode, cam 1402 will not stop or restrict the movement of cam bar 926 whereby a single mode operation is achieved. For example, when the trigger is pulled, sear 116 releases striker 102 and second sear end 208 swings above the elastic lip. The trigger needs to be reset before it can be retriggered again.

Figure 18:
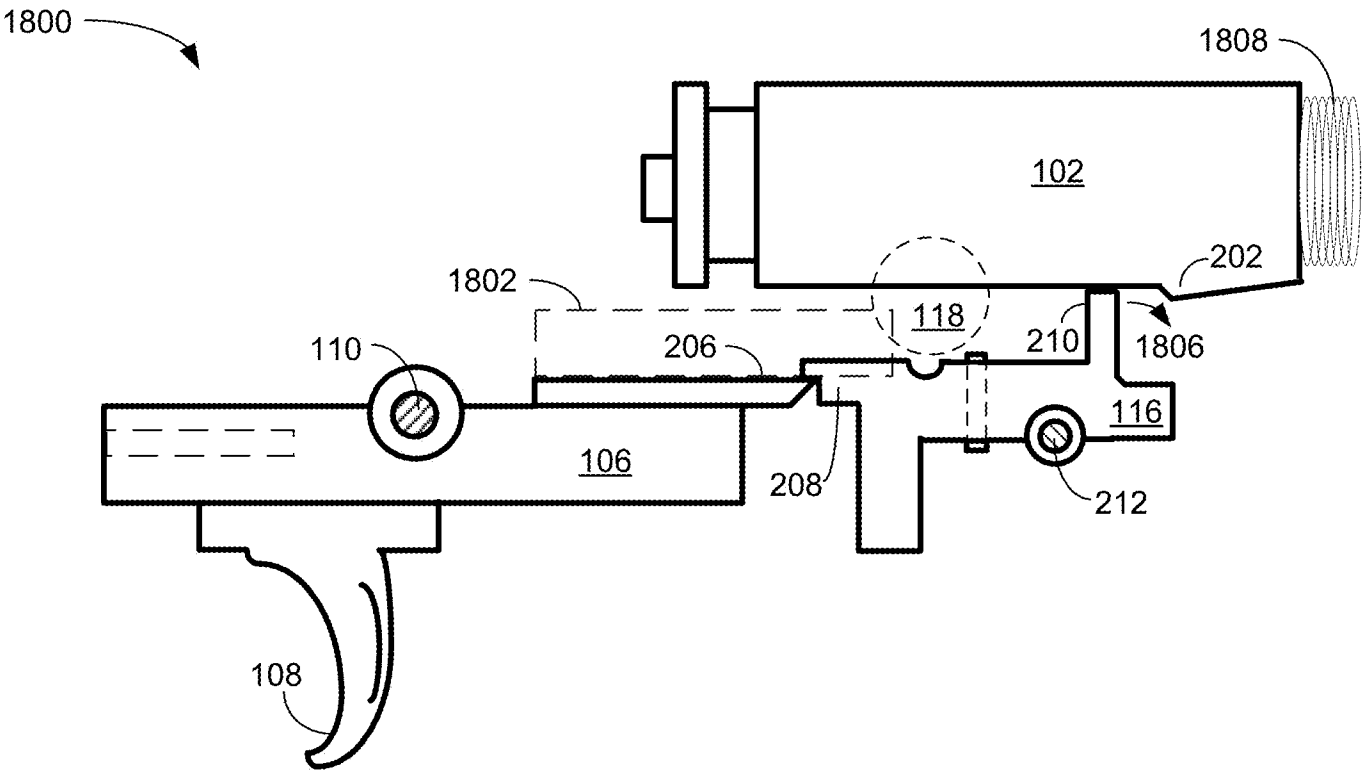
FIG. 18 is a block diagram illustrating a training mode using self-resetting trigger system in accordance with one embodiment of the present invention.

FIG. 18 is a block diagram 1800 illustrating a training mode using self-resetting trigger system in accordance with one embodiment of the present invention. When switch 118 is selected to a training mode, training component 1802 pushes striker 102 closer to striker spring 1808 whereby anchoring notch 202 of striker 102 is disconnected from first sear end 210 of sear 116. When lever 108 is pulled or squeezed, first sear end 210 moves or swings in a direction according to arrow 1806. Although sear 116 pivots in a direction indicated by arrow 1806, striker 102 is not released since first sear end 210 is not engaged with notch 202. An advantage of not cycling striker 102 during the training mode is that it reduces wearing and/or damage of striker 102 and sear 116.

Figure 19:
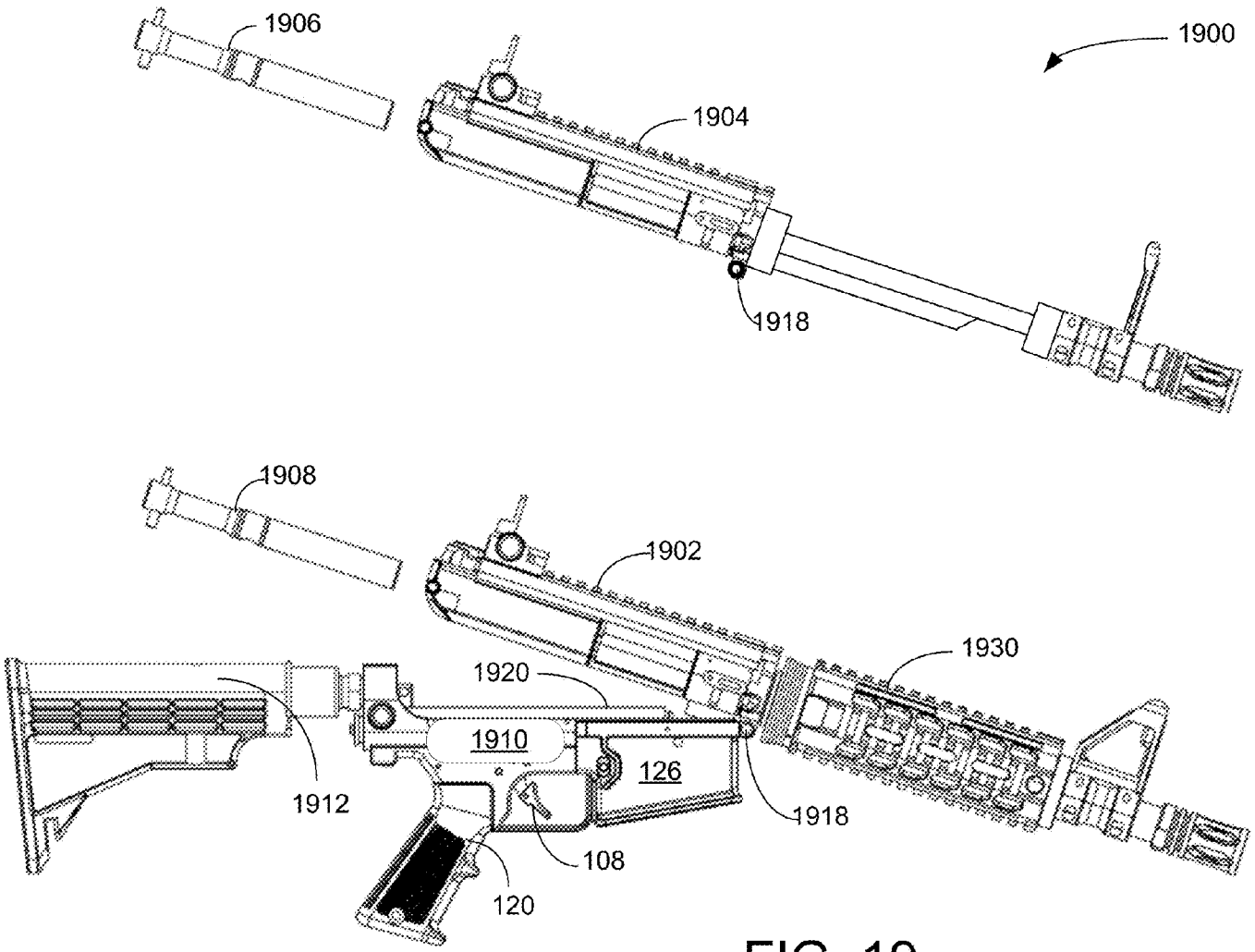
FIG. 19 is a diagram illustrating a launcher using self-resetting trigger system in accordance with one embodiment of the present invention.

FIG. 19 is a diagram illustrating an exemplary projectile launcher using self-resetting trigger system in accordance with one embodiment of the present invention. Diagram 1900 illustrates a projectile launcher in an open position. It should be noted that the projectile launcher can be non-lethal, less-lethal, or lethal firearm(s). For example, paintball upper receiver 1902 can be replaced with firearm upper receiver 1904. It should be noted that the underlying concept of the exemplary embodiment(s) of the present invention would not change if one or more components (or units) were added to or removed from diagram 1900.

The launcher, in one aspect, includes an upper receiver 1902, a lower receiver 1920, a barrel assembly 1930, and a buttstock 1912. Upper receiver 1902, also known as upper paintball marker or top paintball assembly, includes a bolt chamber configured to house a bolt 1908. Upper receiver 1902 is structured with a first end and a second end wherein the first end is used for coupling to barrel assembly 1930 and the second end couples to a coupler or buttstock 1912. In one embodiment, the first end of upper receiver 1902 includes a pivot hole used to couple to lower receiver 1920 using a pivotal pin 1918.

A function of bolt 1906 or 1908 is to push a paintball into a firing chamber and then channels a stream of compressed or pressurized gas or air to launch an object such as a paintball. The objects could be as any projectiles, such as, but not limited to, paintballs, non-lethal projectiles, less-lethal projectiles, and/or lethal projectiles. For example, a non-lethal projectile can be a food-color based paintball, and lethal projectile can be a bullet. It should be noted that the terms "paintball," "non-lethal projectile," "less-lethal projectile," and "lethal projectile" may be used interchangeably herein.

Lower receiver 1920, which is also known as lower paintball marker or bottom paintball assembly, includes a firing control chamber configured to house a striker. In one example, lower receiver 1920 is structured with a first end and a second end wherein the first end is used for coupling to barrel assembly 1930 and the second end is used for coupling to buttstock 1912. In one embodiment, the first end of lower receiver 1920 includes a pivot hole configured to couple to the first end of upper receiver 1902 using pivotal pin 1918. In one embodiment, lower receiver 1920 further includes a self-resetting trigger 1910 including lever 108 used to provide a triggering mechanism for a user.

In an alternative embodiment, upper and lower receivers are fabricated into a single apparatus which also employs a self-resetting trigger 1910.

The exemplary aspect of the present invention includes various processing steps, which will be described below. The steps of the aspect may be embodied in machine and/or mechanical operations. Alternatively, the steps of the exemplary aspect of the present invention may be performed by specific components that contain structural devices for performing the steps.

Figure 20:
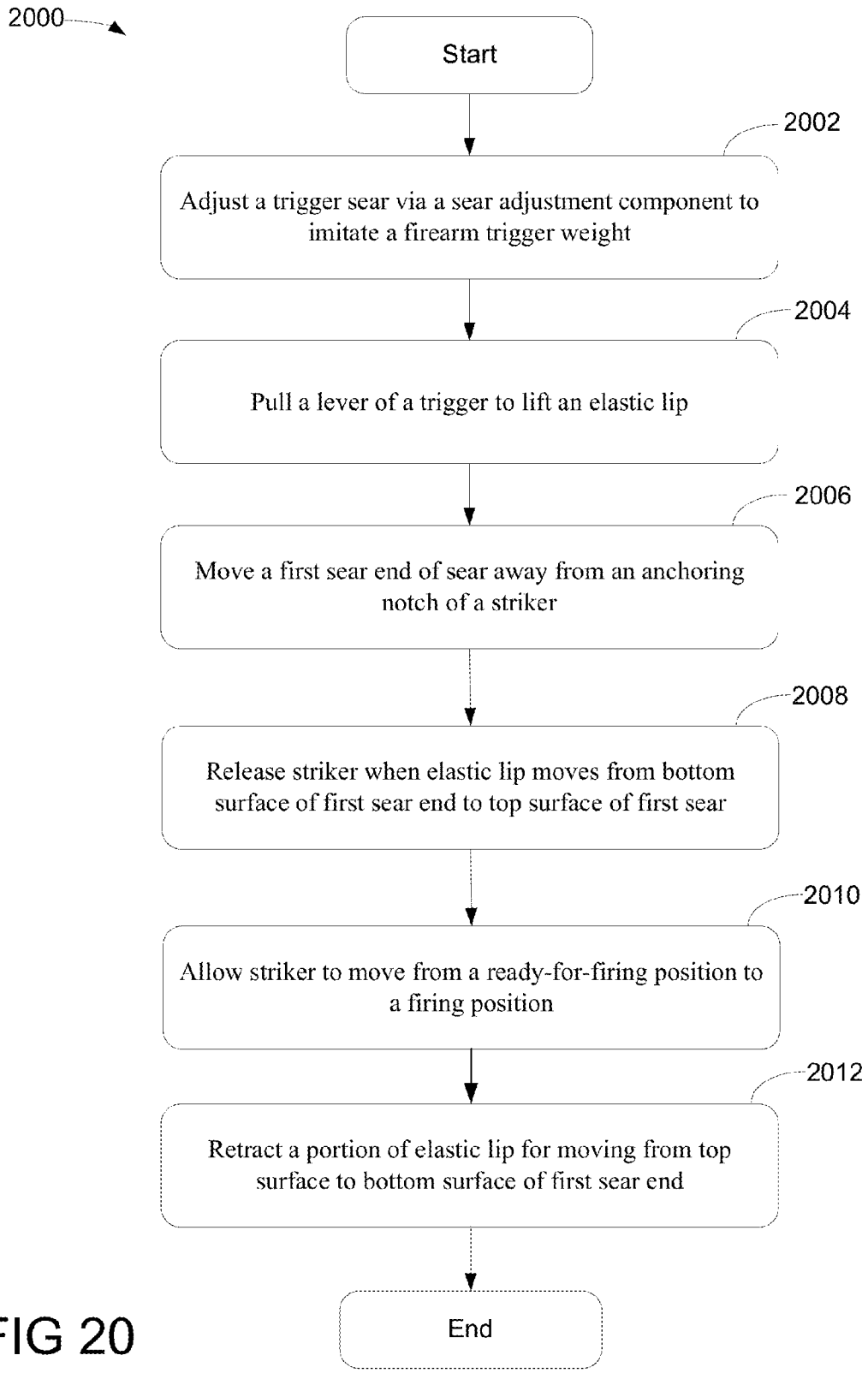
FIG. 20 is a flowchart illustrating a process of calibrating triggering system to imitate firearm triggering system in accordance with one embodiment of the present invention.

FIG. 20 is a flowchart 2000 illustrating a process of calibrating triggering system to imitate firearm triggering system in accordance with one embodiment of the present invention. Flowchart 2000 illustrates a process of launching an object using a self-resetting triggering mechanism. At block 2002, the process allows a user to adjust a trigger sear via a sear adjustment component to imitate triggering weight of a firearm. For example, adjusting trigger pulling weight can be adjusted to make the pulling weight similar to the pulling weight of a rifle. It should be noted that allowing the striker moves from a ready-for-firing position to a firing position includes launching a paintball or ammunition.

At block 2004, a lever of a trigger is pulled to lift an elastic lip situated at one end of a trigger disconnector, a first sear end of sear, at block 2006, subsequently moves away from an anchoring notch of a striker in response to the lifting movement of the elastic lip. At block 2008, the striker is released when the elastic lip moves from the bottom surface of first sear end to the top surface of first sear end. At block 2010, the striker is allowed to move from a ready-for-firing position to a firing position to launch an object. At block 2012, a portion of the elastic lip is retracted to move the elastic lip from the top surface of the first sear end to the bottom surface of the first sear end via a slopped ramp at one side of the elastic lip in response to a trigger spring. Once the elastic lip is under the first sear end, the trigger is reset and it is ready for the next trigger.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. An apparatus able to fire an object, comprising:

a striker including an anchoring notch and configured to slide between a firing position and a ready-for-firing position for launching an object;

a substantially L-shaped sear, having a first sear end and a second sear end, configured to hold the striker to the ready-for-firing position when the first sear end engages with the anchoring notch of the striker; and a trigger, capable of self resetting independent from movements of the striker, containing an elastic lip with a ramp and able to maintain the substantially L-shaped sear in a ready position when the elastic lip and the second sear end are coupled in a lock position, wherein the elastic lip is configured to flexibly move from at least a portion of a top surface of the second sear end to at least a portion of a bottom surface of the second sear along the ramp.

2. The apparatus of claim 1, further comprising a firing chamber coupled to the striker and configured to launch a paintball in response to the firing position of the striker.

3. The apparatus of claim 1, further comprising a firing chamber coupled to the striker and configured to fire a bullet in response to the firing position of the striker.

4. The apparatus of claim 1, wherein the striker is able to slide within a firing channel in a receiver that allows the striker to travel between the firing position to the ready-for-firing position.

5. The apparatus of claim 1, wherein the substantially L-shaped sear includes a sear adjustable component capable of adjusting lever force back to an index finger when a squeezing pressure is applied by the index finger.

6. The apparatus of claim 5, wherein the lever force back is adjusted to approximately same as lever force back of a rifle.

7. The apparatus of claim 5, wherein the adjustment of lever force back includes a calibrator able to calibrate takeup and creep associated with the trigger.

8. The apparatus of claim 1, wherein the trigger includes a lever, a calibrator, and a trigger disconnector wherein the trigger disconnector includes the elastic lip situated at one end of the trigger disconnector.

9. The apparatus of claim 8, wherein the calibrator is configured to adjust elasticity of the elastic lip and alters creep pressure against squeezing force generated by a finger.

10. The apparatus of claim 1, wherein the ramp of the elastic lip includes a slopped surface configured to facilitate moving of the elastic lip from a top surface of the second sear end to a bottom surface of the second sear end to hold the substantially L-shaped sear in a ready position before the trigger is pulled.

11. A launcher able to launch an object, comprising:

a striker configured to slide between a firing position and a cocked position for launching an object;

a sear, having a first sear end and a second sear end, configured to hold the striker to a ready-for-firing position when the first sear end engages with an anchoring notch of the striker;

a trigger, capable of self resetting independent from movement of the striker, able to maintain the sear in a ready position when an elastic lip of the trigger and the second sear end are coupled in a lock position, wherein the elastic lip is configured to flexibly move from at least a portion of top surface of the second sear end to at least a portion of bottom surface of the second sear along the ramp; and a switch having a plurality of modes and coupled to the trigger, wherein the striker is disconnected from the sear when the switch is set to a training mode.

12. The launcher of claim 11, wherein the trigger is adjustable to imitate trigger operation of a rifle when the switch is set to a rifle mode.

13. The launcher of claim 12, wherein the trigger is adjustable to imitate trigger operation of a semi-automatic firearm when the switch is set to an automatic mode.

14. The launcher of claim 11, wherein the trigger contains a mode bar extending from a trigger disconnector of the trigger wherein the mode bar is able to engage with a cam of the switch for facilitating mode selections.

15. The launcher of claim 14, wherein the cam of the switch is configured to include an automatic selection and a rifle selection.

16. The launcher of claim 15, wherein the cam of the switch sets the elastic lip to a predefined orientation which maintains the sear in a released position as long as the lever of the trigger is continuously pulled.

* * * * *